US012325984B2

(12) United States Patent
Vallvé Bertran et al.

(10) Patent No.: US 12,325,984 B2
(45) Date of Patent: Jun. 10, 2025

(54) SYSTEMS AND METHODS FOR MEASURING FORCES IN EARTH MOVING MACHINERY AND CONTROL THEREOF, AND AUTOMATIC OR SEMI-AUTOMATIC MACHINERY

(71) Applicant: Metalogenia Research & Technologies, S.L., Barcelona (ES)

(72) Inventors: Nil Vallvé Bertran, Barcelona (ES); Javier Triginer Castañé, Barcelona (ES); Jordi Marquez Llinas, Barcelona (ES); Albert Gimeno Tordera, Barcelona (ES); Ester Alonso Frigola, Girona (ES); Jorge Triginer Boixeda, Barcelona (ES)

(73) Assignee: METALOGENIA RESEARCH & TECHNOLOGIES, S.L., Barcelona (ES)

( * ) Notice: Subject to any disclaimer, the term of this patent is extended or adjusted under 35 U.S.C. 154(b) by 531 days.

(21) Appl. No.: 17/312,897

(22) PCT Filed: Dec. 12, 2019

(86) PCT No.: PCT/EP2019/084995
§ 371 (c)(1),
(2) Date: Jun. 10, 2021

(87) PCT Pub. No.: WO2020/120718
PCT Pub. Date: Jun. 18, 2020

(65) Prior Publication Data

US 2022/0025617 A1 Jan. 27, 2022

(30) Foreign Application Priority Data

Dec. 12, 2018 (EP) ..... 18382913

(51) Int. Cl.
*E02F 9/26* (2006.01)
*E02F 3/30* (2006.01)
(Continued)

(52) U.S. Cl.
CPC ..... *E02F 9/268* (2013.01); *E02F 9/2029* (2013.01); *E02F 9/205* (2013.01); *E02F 9/24* (2013.01);
(Continued)

(58) Field of Classification Search
CPC ..... E02F 9/268; E02F 9/2029; E02F 9/205; E02F 9/24; E02F 9/265; E02F 9/2808; E02F 3/308
See application file for complete search history.

(56) References Cited

U.S. PATENT DOCUMENTS 8,958,905 B2 2/2015 Bamber et al.
10,126,819 B2 11/2018 Wakuda et al.
(Continued)

FOREIGN PATENT DOCUMENTS

EP 3040485 7/2016
JP H-08296603 A 11/1996
(Continued)

OTHER PUBLICATIONS

Beisteiner, F. et al., (Feb. 1, 1992). "Verschleißuntersuchungen am Grabgefäß im Felshaufwerk arbeitender Hydraulikbagger - Messung von Grabkräften und Grabbenwegungen", Baumaschinentechnik B.M.T., Bauverlag GmbH. vol. 39, No. 1; pp. 9-13.
(Continued)

*Primary Examiner* — Hongye Liang
*Assistant Examiner* — Nada Mahyoob Alqaderi
(74) *Attorney, Agent, or Firm* — Snell & Wilmer LLP

(57) ABSTRACT

System (1-3) for earth moving machinery (100), comprising: a plurality of wear elements (10-15) adapted for coupling
(Continued)

with a blade (111) of digging implements (110) of an earth moving machine (100); one or more sensors (20) for measuring forces, each sensor of the one or more sensors (20) being arranged in one wear element of the plurality of wear elements (10-15) or between two wear elements of the plurality of wear elements (10-15); and central control means (50) for processing measurements of the one or more sensors (20) in order to calculate force withstood by the wear elements (10-15).

21 Claims, 22 Drawing Sheets

(51) Int. Cl.
*E02F 9/20* (2006.01)
*E02F 9/24* (2006.01)
*E02F 9/28* (2006.01)

(52) U.S. Cl.
CPC ..... *E02F 9/265* (2013.01); *E02F 9/2808* (2013.01); *E02F 3/308* (2013.01)

(56) References Cited

U.S. PATENT DOCUMENTS 11,739,504 B2 * 8/2023 Clarke ..... E02F 9/2816 29/703
2012/0000097 A1 * 1/2012 Hall ..... E02F 9/2866 37/195
2012/0321425 A1 * 12/2012 Shatters ..... F15B 21/087 414/815
2013/0086827 A1 4/2013 Renski et al.
2013/0147633 A1 6/2013 Sumrall et al.
2014/0119867 A1 * 5/2014 Wen ..... F15B 21/14 60/416
2015/0149049 A1 5/2015 Bewley et al.
2015/0247513 A1 * 9/2015 Morris ..... E02F 9/2292 701/50
2015/0284935 A1 10/2015 Egger et al.
2018/0216317 A1 * 8/2018 White ..... F15B 13/021
2018/0305901 A1 * 10/2018 Carpenter ..... E02F 9/26
2019/0284784 A1 * 9/2019 Darlington ..... E02F 9/267
2020/0011030 A1 * 1/2020 Nakano ..... E02F 9/2242
2020/0032490 A1 * 1/2020 Ready-Campbell .... E02F 9/262

FOREIGN PATENT DOCUMENTS

JP 2005/163470 6/2005
JP 2012/072636 4/2012
JP 2018028212 A 2/2018
WO 2011/139696 A2 11/2011
WO WO 2013/033164 3/2013
WO WO 2016/131007 8/2016
WO 2017017289 A1 2/2017
WO WO-2018095536 A1 * 5/2018 ..... E02F 9/264

OTHER PUBLICATIONS

International Search Report and Written Opinion dated Mar. 10, 2020, directed to International Application No. PCT/EP2019/084995; 11 pages.

* cited by examiner

SYSTEMS AND METHODS FOR MEASURING FORCES IN EARTH MOVING MACHINERY AND CONTROL THEREOF, AND AUTOMATIC OR SEMI-AUTOMATIC MACHINERY

CROSS-REFERENCE TO RELATED APPLICATIONS

This application is a U.S. National Stage Application under 35 U.S.C. § 371 of International Patent Application No. PCT/EP2019/084995, filed on Dec. 12, 2019, which claims priority to European Patent Application No. 18382913.4, filed on Dec. 12, 2018, the contents of which are hereby incorporated by reference in their entireties.

TECHNICAL FIELD

The present invention relates to the field of systems for earth moving machinery. More particularly, the present invention relates to systems and methods for measuring forces in earth moving machinery, and systems and methods for controlling such machinery, and the machines themselves. Earth moving machines may be, for example, excavators, loaders for public works jobs and mining, dredging vessels, or the like.

BACKGROUND OF THE INVENTION

The use of earth moving machines such as excavators or loaders, for example, for working in construction sites, mining, dredging, etc., is common. These machines generally comprise digging implements (e.g. bucket, shovel, dredgehead, etc.) in which the material are collected. The digging implements, e.g. the bucket, are subjected to high stresses and significant wear, mainly in the area referred to as blade. For this reason, generally blades usually have a plurality of installed elements serving to protect the blade and the digging implements against wear and to increase the penetration of the bucket into the terrain.

These protective elements include:

- teeth: which have the function of penetrating the terrain and protecting the blade of the digging implements;
- tooth bars: which have the function of protecting the blade and supporting the teeth;
- front guards or shrouds: which have the function of protecting the lip in the areas comprised between the teeth and also perform the function of penetration, but to a lesser extent than the teeth;
- side guards or shrouds: which protect the sides of the digging implements;
- fixing elements: elements for fixing the wear elements between them (e.g. the teeth to the tooth bars), or for fixing the wear elements to the blade of the digging implements (e.g. the tooth bar to the blade).

All these elements are subjected to intense mechanical requirements, straining and heavy wear. For this reason, they usually have to be replaced with certain frequency, when the wear experienced requires it. As a whole, these protective elements are usually referred to as wear elements or ground engaging tools, i.e. GETs.

In these earth moving machines, the most important parameters are their reliability, productivity and efficiency, i.e. the cost per amount of excavated and loaded material and the incident-free machine operation time.

It is important to measure and calculate said mechanical requirements or forces to which the wear elements are subjected, especially during the most demanding part of the operation of the machine that is usually the excavation and load operation, to guarantee machine productivity and efficiency. Nowadays, in order to know in the most precise manner possible the forces, pressures and loads that the teeth and other wear elements are subjected to, theoretical studies are performed, offering complex and sophisticated mathematical solutions; they are an approximation of the real terrain data.

These current solutions include mechanical simulations which are complex and theoretical, and they are an approximation of the complete behavior of the machine and the operation thereof, to offer the best design criterion of the machine, especially in particular situations such as with particular ground conditions. Since the information provided by these current solutions is theoretical, it is difficult to correlate it with the reality of the excavation operation. What is more, as these simulations are theoretical and are only an approximation of the real case, precisely due to the lack of real and accurate data of the stresses that GETs are subjected to, in the state of the art in order to minimize the risk of breaking the GETs too quick due to the stresses, they are designed overengineered for the operation of the machine, for example taking into account the maximum breakout force of the machine even if in many occasions the digging force does not arrive at this maximum breakout force. This, in turn, results in an efficiency of the excavation procedure that is lower than that of a machine having GETs sized according to the level of stresses that they are to be subjected to.

Knowing the forces exerted on the GETs in an accurate manner would not only make possible to arrange wear elements on the blade of a bucket that are more suitable for earth moving conditions, but it would also make possible to: determine whether the earth moving operations are carried out efficiently and make them more efficient, reduce the risk of breaking the GETs, predict or better predict the useful life of the wear elements, and assist in the maneuvering of or even control the machine so as to e.g. improve the cost per ton moved, reduce energy consumption, improve useful life of the wear elements and/or the machine, etc.

Moreover, knowing said forces would also enable to determine what is the reaction of the terrain on the GETs throughout the excavation and load operation, something that provides information on how the ground is being engaged. In contrast, simply determining the reaction of the terrain with respect to a single wear element (or the bucket, for example) is not representative of how the terrain is actually reacting and, hence, the information is not sufficient to be able to tell how the excavation and load operation is being carried out. Such information would be useful for both the operation currently under way and the tailoring of wear elements for said operation (or similar ones, i.e. in similar conditions).

Accordingly, there is an interest in providing systems and methods for determining the forces, pressures and/or loads to which wear elements of earth moving machinery are subjected so that both reliance on hypothetical variables due to the lack of metrics is reduced and reaction of the terrain with respect to a plurality of wear elements is determinable. There is also an interest in providing systems and methods for assisting an operator of a machine or even controlling an operatorless machine based on said forces, pressures and/or loads, and also in providing such machines.

DESCRIPTION OF THE INVENTION

The systems, methods and machines of the present invention are intended to overcome the above problems.

A first aspect of the invention relates to a system for earth moving machinery, in particular for digging implements thereof (e.g. a bucket, a shovel, a cutterhead or a dredgehead), the system comprising: a plurality of wear elements adapted for coupling with a blade of the digging implements of an earth moving machine, and one or more sensors for measuring forces (for example, strains or unitary deformations), each sensor of the one or more sensors being arranged in one wear element of the plurality of wear elements or between two wear elements of the plurality of wear elements.

The system is a force measuring system that makes possible to measure forces in earth moving machinery (e.g. excavators, loaders, dredging vessels, etc.) and, more particularly, the mechanical requirement or force withstood by wear elements for earth moving machinery. Owing to the measurements of the sensor(s), which namely are field acquisition of real data, the use of theoretical mathematical approximations can be avoided in the design of earth moving machinery and wear elements or GETs thereof and, moreover, they can also be avoided in the operation of such machines with wear elements; the acquisition of field data makes possible to adjust the way a machine operates.

Each sensor of the one or more sensors makes possible to measure the change in state in one or more wear elements due to the mechanical requirements or force withstood by said one or more wear elements while the machine is working, and especially (but not only) during excavation and load operations in which the digging implements (the term bucket will be used hereinafter as equivalent to digging implements, yet the disclosure will equally apply to other digging implements such as shovels, cutterheads or dredgeheads) are engaging the ground whereby some or all wear elements contact the ground. In this sense, said one or more wear elements are at least the wear element in which the sensor is arranged and, preferably, one or more other wear elements mechanically coupled with said wear element; alternatively, when the sensor is between two wear elements, said one or more wear elements are one of said two wear elements and, preferably, both wear elements and, more preferably, also one or more other wear elements mechanically coupled with the one or both wear elements. The change in state can be one or more of: deformation, pressure, load, torque, position, etc., and such data is processed for determining the real mechanical requirement or force to which the wear element(s) is/are subjected to, and also the angle of the force to which the wear element(s) is/are subjected to owing to the determination of the force in the different axes.

The plurality of wear elements of the system comprises any one of: teeth, tooth bars, guards (front and/or side ones), fixing elements (in the form of e.g. pins, clamps, etc.), and combinations thereof. In this respect, in some embodiments, the plurality of wear elements comprises a plurality of tooth bars, a plurality of teeth, a plurality of guards, and a plurality of fixing elements.

By arranging one or more sensors in the wear elements, the sensor(s) provide more accurate data of each position individually than sensor(s) arranged in other structural elements of the machine (e.g. bucket, lip, boom, etc.) which do not have direct contact with the terrain, that is to say structural elements other than GETs. Due to the no engagement of such other structural elements with the ground, it is not possible to determine from measurements in these elements how the ground exerts force on the different wear elements. Therefore, from such measurements, one single wear element could be receiving all the force, or some of them, or all of them, and it would not be possible to know. Additionally, the farther away the sensor is from the location where the ground exerts the force on the wear elements, the lower the tension resulting from the force and the lower the sensitivity to the directionality of the force, thereby making impossible to measure the force applied on the wear elements and with which angle. By way of example, the tension of the force may exceed 1200 MPa on the teeth, be of about 600 MPa on the tooth bars, and be of about 50 MPa or less on the bucket beyond the blade thereof. While on the teeth and on the tooth bars the force values are representative of the force applied to the wear elements and the directionality thereof, that is not the case on the bucket, not to mention in other elements different from the bucket.

A system according to the present disclosure is preferably designed and manufactured taking into account the different types of wear elements in terms of dimensions, shapes and number thereof. That is to say, different sets of GETs for buckets can be designed and manufactured considering that one or more sensors for measuring forces are to be arranged therein. In this way, systems according to the present disclosure can be produced in mass, resulting in cost-effective manufacturing thereof owing to the possibility of implementing the systems on an industrial level. This is preferred since GETs need to be replaced from time to time, some wear elements more frequently than others, hence replacement of the sensors and any electronics of the systems is also necessary; the replacement may be carried out at the same time that the wear elements are replaced so as to reduce the time a machine is inactive.

In some embodiments, one, some or each sensor of the one or more sensors are arranged in one wear element of the plurality of wear elements and remaining sensors (none, one or some) of the one or more sensors are arranged between two wear elements of the plurality of wear elements. In some embodiments, one, some or each sensor of the one or more sensors are arranged between two wear elements of the plurality of wear elements and remaining sensors (none, one or some) of the one or more sensors are arranged in one wear element of the plurality of wear elements.

In some embodiments, each sensor of the one or more sensors is one of: a strain gauge, a pressure gauge, a relative displacement gauge, an optical fiber strip, and a piezoelectric strip. In some of these embodiments, all sensors of the one or more sensor are a same type of gauge or strip.

In some embodiments, at least one sensor (or each sensor) of the one or more sensors is arranged in a cavity formed in the respective wear element in which the at least one sensor (or each sensor) is arranged.

In some of these embodiments, the at least one sensor (or each sensor) is arranged in a wall delimiting the cavity.

In some of these embodiments, one or more wear elements of the plurality of wear elements having at least one sensor arranged therein have axial, transversal and vertical axes; and one, some or each sensor in the cavity is/are arranged in one or more walls delimiting the cavity with respect to the transversal or vertical axis thereof (e.g. side walls), and/or one, some or each sensor in the cavity is/are arranged in a wall delimiting the cavity with respect to the axial axis thereof (e.g. front wall).

By way of example, one or more sensors are arranged in the front wall of the cavity, which in preferred embodiments is a wall of the cavity in the axial axis that is closest to an edge of the plurality of wear elements to come into contact with the ground (the edge of the teeth that is to contact the ground), and, optionally, one or more sensors are arranged in a side wall or side walls of the cavity. By way of another example, one or more sensors are arranged in a side wall or side walls of the cavity and, optionally, one or more sensors are arranged in the front wall of the cavity. In some examples, the front wall is the only wall delimiting the cavity with respect to the axial axis owing to an opening that forms the cavity that is on the opposite end in relation to the axial axis.

By arranging sensor(s) in the front wall and/or the side wall(s) the measurements of forces may be more accurate than measurements with sensors arranged in other locations due to the distribution of forces during an excavation process. In other words, the way in which the forces are usually distributed over the plurality of wear elements is such that the forces are exerted more significantly on the walls of the cavity, thus a more accurate value of the strains exerted on the wear elements can be measured with sensors arranged in these locations.

In some embodiments, one, some or each cavity formed in wear elements has one or more sensors arranged therein. In some of these embodiments, the number of sensors arranged in the cavity or cavities is between 3 and 5.

Preferably, in these cases, one or some sensors are arranged in the front wall, and one or some sensors are arranged in a side wall or side walls, thereby making possible to measure forces in different locations of the cavity. This, in turn, makes possible to determine more accurately the forces that the wear elements are subjected to because the forces are not applied to the walls of the cavity evenly; the strains or unitary deformations measured with sensors arranged at opposite walls usually have considerable differences due to how the terrain exerts forces on the tooth during operation of the machine. The measurement of each of these strains or unitary deformations is important for both the optimization of the design of the wear elements and the machine, and for the optimization of the operation of the wear elements and the machine.

In some embodiments, one or more cavities formed in the wear elements have a tapered shape, the tapering preferably being with respect to an axial axis of the corresponding wear element(s). In some of these embodiments, the one or more cavities are narrower in a first portion thereof closest to a first edge of the respective wear element to come into contact with ground than a second portion closest to a second edge opposite to the first edge.

In some embodiments, a first thickness $t_1$ is defined between an outer part of the wear element and the cavity (having at least one sensor arranged therein) in a first portion of the cavity that is closest to a first edge of the respective wear element to come into contact with ground than a second portion closest to a second edge opposite to the first edge, and a second thickness $t_2$ is defined between the outer part of the wear element and the cavity in the second portion, and $t_1$ is smaller than or equal to $t_2$ (and both $t_1$ and $t_2$ are greater than 0). In some of these embodiments, said cavity (or cavities) is formed in a wear element that is a tooth or a tooth bar.

In some embodiments, one or more cavities or each cavity in which at least one sensor is arranged comprises an element for protecting the respective at least one sensor or control electronics thereof. In some of these embodiments, the element is or (further) comprises a coating, e.g. a silicone coating, a resin coating, etc. In some of these embodiments, the element is or (further) comprises a solid protective element, e.g. a plate that may be made of e.g. metal, such as e.g. steel.

The forces applied to the wear elements during excavation and load operations are usually in the range of hundreds of kilonewtons, and said forces are also applied to any element within the wear elements. The provision of protective elements in the form of coatings or solid protective elements improves the useful life of the sensors and any components associated therewith, for example control electronics as described below. Otherwise, it may occur that the one or more sensors do not measure strains or unitary deformations accurately because they move as a result of the engagement of the wear elements with the ground, and possibly the sensor(s) may stop working due to the mechanical requirements the one or more sensors are subjected to. When this occurs, the wear elements are still in operating condition but it is not possible to measure the forces they are subjected to anymore, and the personnel or the machine thereby being unable to know what is the working condition of the wear elements and whether the ground engaging is being carried out effectively. Both of these problems negatively impact the whole operation of the machine since the status of the wear elements cannot be determined based on real data, which may result in the sudden breaking thereof that causes halting of the operation of the machine, and the cost per ton moved normally increases as less data about the ground engaging operation is provided, to name few adverse situations.

In some embodiments, the system further comprises control electronics coupled with the one or more sensors. In some of these embodiments, the control electronics are arranged in a cavity of one wear element of the plurality of wear elements, thereby simplifying the data transmissions between the sensor(s) and the control electronics as the communications can be carried out in wired form, or in wireless form but with few interferences due to a short separation between sensors and control electronics, and few or no obstacles between the two. The provision of control electronics simplifies the transmission of data to other components of the system, such as central control means that are described below, or to control center characteristic of the machine, for example. The control electronics are preferably provided with a communications module including an antenna for wireless data transmission and reception.

In some embodiments, the system further comprises central control means for calculation of force withstood by the wear elements based on measurements (e.g. strains, unitary deformations) of the one or more sensors. In some of these embodiments, the central control means are communicatively coupled with the one or more sensors, and/or communicatively coupled with the control electronics (in those embodiments in which the system comprises said electronics). The communicative coupling is in wireless form, for example by way of RF communications, but in some embodiments the communicative coupling is in wired form; to this end, the central control means may be provided with a communications module including an antenna for wireless data transmission and reception.

The central control means are configured for information purposes so as to notify, for instance to the operator of the machine, whether the force is exceeding a predetermined threshold (e.g. predetermined excessive force threshold), with the subsequent risk of the concerned wear element or elements breaking; and/or whether the force is lower than an optimal operating level (e.g. predetermined optimal force threshold), with the subsequent possibility of being capable of withstand more force and, thus, being capable of excavating supplying more force. Both of these type of notifications may lead to improvement or optimization of the excavation and loading cycle with reduced risk of experiencing the breaking of the concerned wear element or elements, or even without any immediate risk at all because subsequent forces will be measured again with the one or more sensors, thus subsequent excavation with the machine will be monitored for excessive or suboptimal force that the wear element(s) is/are subjected to as more excavation force is applied thereto.

The central control means comprises one or more processors, one or more memories, and a communications module for receiving data from the sensor(s) or the control electronics (either as wireless or wired communications).

In some embodiments, the central control means comprise at least one processor and at least one memory per wear element having one or more sensors arranged thereon, or per pair of wear elements having one or more sensors arranged therebetween. Each at least one processor calculates the force withstood by the respective sensor(s) based on the measurements thereof, in this way each monitored wear element has at least one processor for calculation of forces thereof.

In some embodiments, the central control means further provide instructions for at least one of: adjusting force applied by the machine, changing an angle of attack of the digging implements (and, thus, of the GETs), and changing a trajectory of the digging implements. To this end, the central control means provide the instructions based on whether the calculated force exceeds the predetermined threshold (e.g. predetermined excessive force threshold), and/or the calculated force is less than an optimal operating level (e.g. predetermined optimal force threshold). The provision of instructions can be carried out by means of e.g. additional one or more processors and additional one or more memories that process the forces calculated for each monitored wear element, in which case the different processors provide the calculated forces to said additional processor(s) for combined processing thereof.

The central control means may assist the operator of the machine by means of instructions for automatically adjusting, regulating and correcting at least one of the force to be applied by the machine, the angle of attack of the bucket and the trajectory of the bucket, thereby assisting the operator to carry out the excavation and loading operation in the most optimal and productive manner based on the predetermined thresholds set in the central control means. This, in turn, prevents unscheduled stoppages thereby improving the cost per ton moved. The way in which the adjustment, regulation and correction are carried out is by applying more or less force to the bucket when engaging the ground (i.e. more or less pressure is applied to the cylinders of the hydraulic system), by changing the angle of attack with which the bucket contacts the ground during the excavation and load operation, and/or by changing the trajectory the bucket follows during the excavation and load operation, the latter being achieved by moving the boom and the stick of the machine.

Additionally or alternatively, said additional one or more processor(s) and one or more memories may process the calculated forces so as to provide information regarding the operation of the GETs and, optionally, of the machine as well.

The processing carried out by the central control means preferably includes performing machine learning so as to progressively determine more accurately the status and operation of the wear elements and, optionally, of the machine as well, which in turn enables the provision of instructions better tailored to the situation in which the wear elements and the machine are in. In this respect, the central control means are capable of using historical data of operation of the wear elements and/or the machine, inputs from the machine received during operation of the machine and/or historical data thereof, etc.

In some embodiments, the central control means calculate the force withstood by the wear elements further based on input(s) of the machine (which are typically provided by the central control of the machine, but can also be provided by the units gathering all the data generated in a respective component or system of the machine). Said input(s) may be one or more of: power that the machine supplies, breakout force (i.e. BOF), energy consumption, performance of a hydraulic system of the machine, etc., which the central control means receives through the communications module thereof. The central control means interprets the input(s) together with the calculated force so that, after complete processing thereof, the means provide outputs instructions that, as aforementioned, automatically adjust, regulate and correct the force to be supplied. In this respect, the input(s) of the machine may result in the adjustment of the predetermined thresholds and, thus, same force values in two different situations may yield different output instructions.

By way of example, when the breakout force and/or the energy consumption is/are above certain values that are defined as excessive and, thus, considered not convenient for the operation of the machine, the predetermined excessive force threshold may be lowered; in this way, even if the force values do not appear to entail risk of breaking of the concerned wear element/s, the overall operation of the machine is such that there is risk that other problems may occur, for instance malfunction of the hydraulic system. The combined data of machine input(s) and force values can be processed by the central control means to make adjustments in the machine by way of instructions. Alternatively, the central control means may not adjust the predetermined thresholds based on the input(s) of the machine, but the force values are adjusted based on said input(s), for example by applying a correcting factor in the form of a real number that varies the force values once processed. In both ways, the same results may be attained.

Likewise, the central control means process both the input(s) of the machine and the force values in order to provide instructions that assist the operator in improving the excavation and loading operation, which as aforementioned may result in performing this operation in the most optimal and productive manner, and preventing unscheduled stoppages thereby improving the cost per ton moved.

When the central control means process the force values only, and when the means use both the force values and the input(s) of the machine, the central control means manage the machine for optimal operation thereof by regulating the force applied during operation depending on the processed data so as to maximize the efficiency of the machine and the productivity of the operation itself.

In the context of the present disclosure, the term "breakout force" is used interchangeably with "applied force" and "digging force" to refer to the force applied to the bucket for engaging the ground.

In some embodiments, the central control means are configured for communicative coupling with a control center characteristic of the machine so as to provide the information from the sensors (as processed by the central control means) to the control center of the machine, thereby enabling the machine to manage the information with the real data provided by the central control means.

Owing to the real time communication between the central control means and the machine, the machine is capable of interpreting the data and make decisions based on the received pressure, force or load readings.

When the force or pressure measured with the sensor(s) of the system results in computed force values that exceed a predetermined threshold (e.g. a predetermined excessive force threshold), which is usually established based on the mechanical properties of the wear elements (e.g. resistance thereof) and, optionally, based on the wear they have been subjected to, the central control means preferably does at least one of: informing an operator, by way of one or more perceptible signals (something that is usually controlled by the control center of the machine, for which reason the central control means provide an instruction to output such signal or signals), of a possible imminent breaking of the concerned wear elements if the applied breakout force is not reduced, and/or if the angle of attack or trajectory of the bucket is not changed for reducing the force exerted on the wear elements, and providing the instruction to the machine to reduce the applied breakout force or change the angle of attack or trajectory of the bucket so as to reduce the likelihood of or even prevent the breaking of the wear elements.

When the force or pressure measured with the sensor(s) is less than the established optimal level (e.g. predetermined optimal force threshold) of said wear elements, which is usually established at least based on the mechanical properties of the wear elements and the wear they have been subjected to if known, the central control means preferably inform an operator, by way of one or more perceptible signals, of the possibility of applying more force during the operation. If the central control means receive input(s) from the machine relative to the limits and condition of other components of the machine, such as motors, hydraulic systems, transmission cables, etc., and the actual structural resistance of the machine, the central control means may inform the operator only when those input(s) are also indicative of a possible increase of breakout force or change in the angle of attack or the trajectory the bucket follows (that would result in a greater applied force) that does not endanger the machine, so if upon processing both the force values and the input(s) the central control means determine possible risk should the applied force be increased, then the means preferably do not inform the operator of a possible increase in breakout force, or the means may inform the operator but also indicating that the operator must consider the limits and condition of those other components, which the central control means also does when not receiving said input(s). Another alternative is that the central control means provide instructions to the machine to increase the applied force or change the trajectory or angle of attack of the bucket for increasing the applied force and, thus, optimize the excavation and loading operation, thereby reducing the loading cycle and improving the efficiency of the operation itself. In this case also, the central control means may determine not to provide the instructions if the means receive said input(s) from the machine and there exists the risk of damaging the machine should the applied force be increased.

On one hand, this allows reducing or preventing breaking of the system (the wear elements, the sensor or sensors, etc.). It prevents unscheduled stoppages of the machines, which are very costly as they affect the productivity of the mine, quarry or construction site; and on the other hand, it allows optimizing the size of the wear elements, seeking the optimal balance between more penetration without the risk of breaking, smaller, more penetrating teeth with assurances that they will not break, because in the event of approaching ultimate stress, the machine receives the corresponding information and/or instructions so as to reduce the breakout force, thereby providing more excavation efficiency, more productivity, with lower energy consumption. The size of the wear elements may be optimized by monitoring the calculated forces resulting from the system of the present disclosure and, possibly, other values of the machine and/or the operation such as energy consumption, tons moved per charging, characteristics of the terrain, etc.; with this information, for example when the subsequent replacement of wear elements is to take place, an operator may decide to do so but with differently-shaped wear elements (e.g. longer or shorter teeth, sharper or blunter teeth) or differently-sized wear elements when the entire GETs or the tooth bars are being replaced, both of which improve the efficiency of the operation. By way of example, when further force could be applied to the wear elements, longer and sharper teeth can improve the operation, whereas when excessive force is being applied to the wear elements, shorter and wider teeth can improve the operation.

This capability of providing data to the machines about the wear elements in real time allows for a dual communication system, i.e., combining data about the machine itself (power, hydraulic system, etc.) with data measured in the terrain with the system. This feedback allows the operator of the machine to have real data which allows making better decisions during the excavation and loading process. Furthermore, the system can assist the operator by automatically regulating, correcting and adjusting the applied force, making the operator's job easier and more precise. The same system can act within an autonomous machine environment, without an operator in the machine itself. Whether it is a remotely controlled machine without an operator in the cab or an autonomous machine, the system makes possible to perform the excavation process with more precision and efficiency and reduce or prevent breaking of the wear elements.

By increasing and reducing the applied force it is preferably meant increasing and reducing the force applied with the cylinders to move the bucket, respectively. By changing the angle of attack to increase or reduce the applied force it is preferably meant modifying one or more angles with which the bucket is to engage the ground because, depending on the angle with which the bucket engages the ground, the resulting applied force is greater or lower, even when no increase or reduction of the force applied with the cylinders is commanded. By changing the trajectory followed by the bucket to increase or reduce the applied force it is preferably meant modifying how the bucket moves throughout the trajectory thereof before engaging the ground because, depending on the way the bucket moves for engaging the ground, the resulting applied force is greater or lower, even when no increase or reduction of the force applied with the cylinders is commanded.

In some embodiments, the system further comprises the machine, the machine comprising the control center communicatively coupled with the central control means.

A second aspect of the invention relates to an earth moving machine comprising: digging implements; and a system according to the first aspect of the invention, the plurality of wear elements thereof being coupled with a blade of the digging implements.

In some embodiments, the machine further comprises a control center for operating the machine. Further, in these embodiments, the system comprises a central control means, the central control means being communicatively coupled with the control center; the central control means provides output instructions to the control center for operating the machine at least based measurements of the one or more sensors; and the control center operates the machine at least based on the output instructions such that the machine is at least partially operated by instructions provided by the control center.

The system enables to act within a semi-automatic (i.e. partially operated by the instructions provided by the control center) and/or an automatic machine environment, i.e. assisting an operator in the operation of the machine or machine digitally operated without an operator therein. The system allows performing the excavation process with greater precision and efficiency, reducing the probability and/or preventing unexpected breaking of the wear elements, through the integration of the data measured by the system and the data provided by the machine itself. Also, in a semi-automatic machine environment, the operator may be within the machine, or remote from the machine, i.e. at other premises from where it may control and operate the machine.

In some embodiments, the machine further comprises computer vision means, first means for detecting both position and orientation of a boom of the machine, second means for detecting both position and orientation of a stick, and third means for detecting both position and orientation of the digging implements.

The computer vision means may be at least one of: camera(s), and a LIDAR system; with such means, it is possible to determine how is the environment and the terrain and, thus, orient the machine and engage the ground with the GETs. The first means, the second means and the third means each comprise sensors providing position and orientation measurements of the boom, the stick and the bucket as known in the art, e.g. camera(s), radar, LIDAR, and sensors for measuring angles between moving parts thereof.

In addition to being communicatively coupled with the central control means, the control center is preferably communicatively coupled (wirelessly) with a controlling station remote from the machine whereby an operator is able to control and operate the machine. To this end, the controlling station comprises one or more user presenting means on which data from the computer vision means, the first, the second and the third means are shown to the operator.

The controlling station further comprises one or more user input means for remote operation of the machine. The controlling station transmits the user instructions to the control center of the machine. The control center of the machine either runs the instructions upon reception of the same, or processes the instructions based on the inputs received from the central control means and any other inputs of the machine. In the latter case, the instructions of the user are one of adjusted, regulated and corrected in accordance with the status of the machine so that, as explained above with reference to the first aspect of the invention, the operator is assisted in the operation of the machine thanks to the data generated within the machine.

When the machine is autonomously operated, the control center at least uses the data from each of the computer vision means, the first means, the second means, the third means, and the central control means to navigate the machine and operate the boom, the stick and the bucket so that the excavation and load operations, the transporting operation, and the discharge operation are effected. In this sense, the data and/or instructions received from the central control means are processed by the control center so as to operate the boom, the stick and the bucket since that data reveals how the excavating operation is being performed, whether the breakout force is excessive or suboptimal, and how the bucket and the wear elements thereof engage the ground.

The measurements from different wear elements are indicative of how they engage the ground, not only from the standpoint of loads on the wear elements themselves, but also from the standpoint of the type of ground that the wear elements engage. Regarding the latter, the force values may indicate particularities of the ground (especially, but not only, when machine learning techniques are applied to these values), something that influences the way the ground is engaged and both the type and size of the wear elements needed for more efficient earth moving.

By way of the computer vision means, the control center navigates the machine within e.g. the quarry so as to perform the different steps of the excavation procedure, and it also moves the machine towards the ground to be engaged such that the distance between the machine and the ground is within a range of distance values for the bucket to be capable of reaching the ground, and with an angle of attack and trajectory of the bucket as determined by the control center or the central control means; in this sense, the computer vision means can further assist in the operation thanks to the data they provide regarding the terrain (e.g. the shape thereof, how it changes upon engaging with the GETs and withdrawing the bucket, etc.). As it is apparent, the angle of attack determined must be the angle of attack with which the bucket engages the ground, thus a distance between the machine and the ground not being properly controlled may result in the bucket engaging the ground with a different angle of attack. Likewise, the control center not only needs to position the machine properly (according to how the ground is going to be engaged) when it comes to distance, but it must also orient the machine properly for engaging the ground as commanded (either by the machine itself, or by the operator, which in some cases is assisted by the machine), therefore the control center processes the data from the computer vision means together with the instructions for ground engaging so that the semi-automatic or automatic operation is properly carried out.

In some embodiments, the control center operates the machine at least based on the output instructions such that the machine is completely operated (i.e. is autonomous) by instructions provided by the control center.

In some cases, the computer vision means are moveable and/or rotatable, and the control center operates the computer vision means for changing the data they provide from the terrain.

A third aspect of the invention relates to an autonomous (i.e. operatorless) earth moving machine according to embodiments of the second aspect of the invention.

A fourth aspect of the invention relates to a method comprising the steps of:

- providing a system in an earth moving machine, the system comprising:
  - a plurality of wear elements adapted for coupling with a blade of digging implements of an earth moving machine; and
  - one or more sensors for measuring forces, each sensor of the one or more sensors being arranged in one wear element of the plurality of wear elements or between two wear elements of the plurality of wear elements;

measuring forces (e.g. in the form of strains or unitary deformations) with the one or more sensors;

processing the measurements of the one or more sensors with central control means so as to calculate forces based on the measurements; and determining, the central control means, an action to be performed based on the calculated forces so that:

when the calculated forces exceed a predetermined excessive force threshold, the action is at least one of: emitting a warning in the form of at least one perceptible signal, and reducing a breakout force of the earth moving machine in an automatic manner; and when the calculated forces are less than a predetermined optimal force threshold, the action is at least one of: emitting a warning in the form of at least one perceptible signal, and increasing the breakout force in an automatic manner.

The system is arranged in the blade of the bucket of the earth moving machine, thereby enabling to acquire real data concerning the forces, pressures and/or loads exerted on the wear elements.

During excavation with the earth moving machine, the one or more sensors measure the strains or unitary deformations that the wear elements are subjected to. The central control means receive, from the one or more sensors, the measurements and process them so as to emit a warning and/or change the breakout force of the machine in accordance with the value of the forces in relation to the predetermined thresholds; the central control means can provide output instructions corresponding to any of these actions so that a control center of the machine performs the action. To this end, the central control means are provided with one or more processors, one or more memories, and a communications module for receiving data from the sensors and, optionally, form the machine, and also for transmitting data to the machine, e.g. to a control center or unit thereof that controls the operation of the machine.

In some embodiments, increasing and reducing the breakout force comprises at least one of: increasing and reducing, respectively, pressure applied to cylinders of a hydraulic system of the machine; changing an angle of attack of the digging implements so as to increase and reduce, respectively, the breakout force; and changing a trajectory followed by the digging implements so as to increase and reduce, respectively, the breakout force.

In some embodiments, the earth moving machine comprises a control center for operating the machine; the action determined with the central control means comprises at least of: reducing the breakout force of the earth moving machine in an automatic manner when the calculated forces exceed a predetermined excessive force threshold; and increasing the breakout force in an automatic manner when the calculated forces are less than a predetermined optimal force threshold. Further, in these embodiments, the control center operates the machine such that the machine is at least partially operated by instructions provided by the control center.

In some embodiments, the machine further comprises: computer vision means; first means for detecting both position and orientation of a boom of the machine; second means for detecting both position and orientation of a stick of the machine; and third means for detecting both position and orientation of the bucket. In some of these embodiments, the control center operates the machine at least based on the action such that the machine is completely operated by instructions provided by the control center.

In some embodiments, the system is a system according to the first aspect of the invention.

In some embodiments, the machine is a machine according to the second or the third aspect of the invention.

Similar advantages as those described for the first aspect of the invention are also applicable to the second, third and fourth aspects of the invention.

A fifth aspect of the invention relates to a method comprising the steps of:

receiving, by a computing apparatus of a crushing station:

values of force applied to a plurality of wear elements of an earth moving machine, or data indicative of characteristics of material charged with the earth moving machine;

determining, by the computing apparatus, characteristics of material at least based on the values of force when said values of force are received; and adjusting, by the computing apparatus, an operation of the crushing station at least based on the characteristics of material received or determined.

The computing apparatus of a station that crushes (namely a crusher) the material resulting from an earth moving operation can process the values of force or the data so as to configure the crushing station in accordance with the characteristics of the material to be crushed. Whether the material is homogeneous, heterogeneous, compacted, rocky, loose or uncompacted, hardness, etc. are important pieces of information for setting the crushing station as optimally as possible for crushing the material at a high rate and with reduced energy consumption.

Upon receiving the values or the data, preferably from a system according to the first aspect of the invention or a machine according to any one of the second and third aspects of the invention, the computing apparatus determines the characteristics of the material (if it is the values of force what is received) and adjust the operation accordingly; else, if the data are received, then the computing apparatus uses that data to adjust the operation accordingly.

In some embodiments, adjusting the operation of the crushing station comprises at least one of: changing a force thereof, changing revolutions thereof, and adjusting a cone thereof.

BRIEF DESCRIPTION OF THE DRAWINGS

To complete the description and in order to provide for a better understanding of the invention, a set of drawings is provided. Said drawings form an integral part of the description and illustrate embodiments of the invention, which should not be interpreted as restricting the scope of the invention, but just as examples of how the invention can be carried out. The drawings comprise the following figures:

in FIG. 5 are also shown force vectors resulting from the use of an earth moving machine with said system.

DESCRIPTION OF WAYS OF CARRYING OUT THE INVENTION

Figure 1:
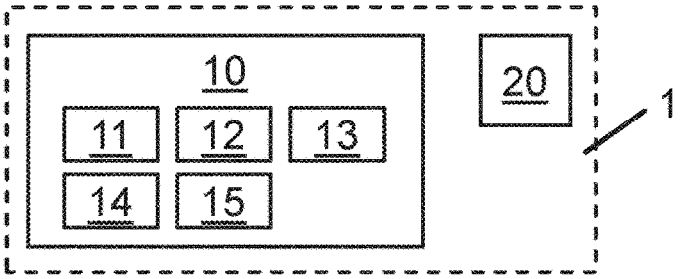
FIGS. 1-3 show systems according to different embodiments in block diagram form.

FIG. 1 shows a system 1 according to some embodiments. The system 1 includes a plurality of wear elements 10 adapted for coupling with a blade of a bucket or a shovel of an earth moving machine. The plurality of wear elements 10 at least comprises teeth 11, tooth bars 12, fixing elements 13, 14, and front and/or side guards 15; different examples of some of these wear elements will be described below with reference to other figures.

The system 1 also includes one or more sensors 20 that is/are arranged in one wear element (attached either to a surface thereof, or to a cavity formed in the wear element) of the plurality of wear elements 10, or between two wear elements (attached either to a space between the surfaces thereof, or to a cavity formed between the two wear elements) of the plurality of wear elements 10. By way of example, the system 1 may comprise thirty sensors 20, fifteen of which are arranged such that there are three sensors in each tooth 11 out of five teeth, and the remaining fifteen sensors 20 are arranged such that there are three sensors in each tooth bar 12 out of five tooth bars.

Each sensor in one of the wear elements provides measurements for calculating force values according to one of the axes, thus at least three sensors are arranged per wear element so as to calculate forces in all three axes.

The sensor(s) 20 is/are configured to measure forces while being arranged in or between wear elements; for instance, the sensor(s) are capable of measuring strains or unitary deformations, which relate to the force applied to the wear elements.

Figure 2:
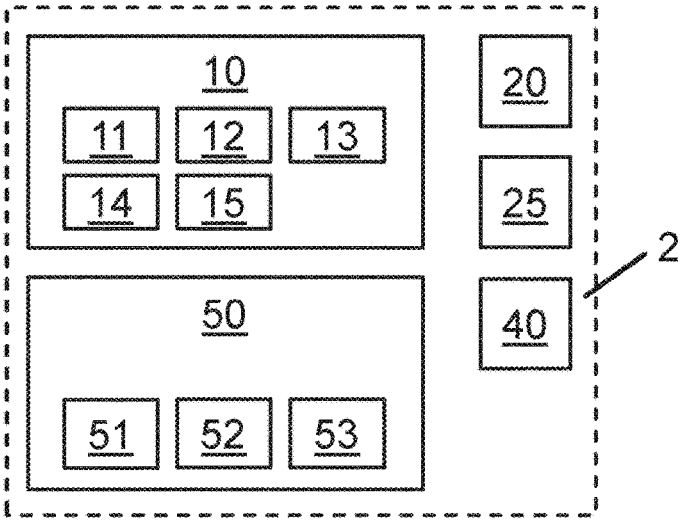

FIG. 2 shows a system 2 according to some embodiments. The system 2 includes the plurality of wear elements 10, the one or more sensors 20, and both control electronics 40 and central control means 50.

The control electronics 40 are communicatively coupled with both the one or more sensors 20 (via wired or wireless communications) and the central control means 50 (via wireless or wired communications; the central control means 50 are preferably not arranged in the same wear element or between the same wear elements, but outside of the wear elements, thus in these cases preferably the communications are wireless) so as to provide the measurements of the sensors 20 to the latter 50 by way of a communications module (not illustrated). Each sensor 20 may have respective control electronics 40, or several sensors 20 arranged in the same wear element 10 or between the same wear elements 10 may share one or more control electronics 40. The control electronics 40 receive the measurements, digitizes them with an analog-to-digital converter, and provides a data stream output with the measurements as digitized or after processing the same; for instance, the control electronics may apply a digital filter to the measurements in order to filter out noise.

The central control means 50 comprise, preferably for each sensor 20 of the system, at least one processor 51, at least one memory 52, and a communications module 53. The central control means 50 receive the measurements from the control electronics 40 and process them so as to calculate force values exerted on the wear elements 10. By means of the communications module 53, these values may then be sent to a control center of a machine incorporating the system 2 for informing the operator about the forces applied to the wear elements 10 during the excavation procedure so that he/she may make decisions on how to operate the machine with knowledge of that data, whether different wear elements may be more suitable for the excavation procedure, and/or whether there is a risk of failure of the wear elements and replacement thereof is convenient. The control center may also process the received force values to provide instructions at least based on the same.

Also, owing to the at least one processor 51, the central control means 50 are capable of providing instructions so as to, for example, command provision of one or more user perceptible signals indicative of a condition of the wear elements 10 or a recommended level of breakout force as determined by the at least one processor 51 using the measurements, and/or instructions so as to, for example, control or assist in the operation of the machine incorporating the system 2 by changing the breakout force, the angle of attack of the bucket of the machine and/or the trajectory followed by the bucket of the machine. The central control means 50 transmit such instructions to the control center of the machine, which in turn may run the instructions as received from the means 50, or process them and modify them in accordance with any measurements the control center has from other components of the machine.

For the provision of the instructions by the central control means 50, the means 50 may also receive, from the machine (e.g. from the control center or from different units thereof), input(s) regarding the status of other components of the machine. Accordingly, the processor(s) 51 of the means 50 processes such input(s) together with the calculated force values, and provides the instructions based on both sources of data.

In order to calculate the forces, a set of equations defining the mechanical behavior of the sensed element are stored in the at least one memory 52 of the central control means 50 that output force values when strains or unitary deformations are received. This set of equations relies on laws of physics and preferably sets static equilibrium conditions such that both the sums of forces is equal to zero and the sums of momentums is equal to zero as known in the art. As in that situation the wear element is in equilibrium and neither moves nor is deformed, the wear element has a given rigidity that can be modelled through simulations, and then the factors in the equations that relate the strains or unitary deformations to the forces exerted on the wear element are calibrated by way of experimental tests so as to arrive at values of the factors that make possible to provide accurate forces values based on the measurements. Said values of the factors thus are calibrated taking into account the positions of the sensors in the wear elements and the number of sensors used when the system is installed in the bucket of a machine.

The system 2 also comprises one or more power supplying devices 25, such as one or more batteries, for at least powering the control electronics 40. Preferably, but not necessarily, one or more of said power supplying device(s) 25 are arranged in the wear elements 10; in this way, whenever the wear elements 10 are replaced, the sensors 20, the control electronics and the power supplying device(s) 25 are replaced as well.

Preferably, one or more power supplying device(s) 25 are arranged at a same location of the central control means 50 for powering the same. The central control means 50 are preferably arranged outside of the wear elements 10 (where space is scarce and, thus, it is challenging to allocate additional processors, memories, and power supplying devices), for example in the cab of the machine. In these cases, the central control means 50 may also be powered by a power supplying device of the machine itself.

In some embodiments, the sensor(s) 20 may have control electronics 40 embedded thereon as to reduce the overall dimensions of sensors and control electronics; for instance, the sensor(s) 20 may have an analog-to-digital converter embedded thereon and a communications module. This can be the case when the space (in or between the wear elements) for arrangement of the sensor(s) 20 and the control electronics 40 requires as much minimization as possible for fitting said components therein. It can be appreciated that the data that can be provided by the system 2 makes possible to tailor the wear elements (for instance, their dimensions, shapes, number, etc.) to the conditions faced by the machine, so as the dimensions of the wear elements may be reduced and therefore avoid overengineering, the size for allocating the sensor(s) 20 and control electronics 40 becomes more limited.

Figure 3:
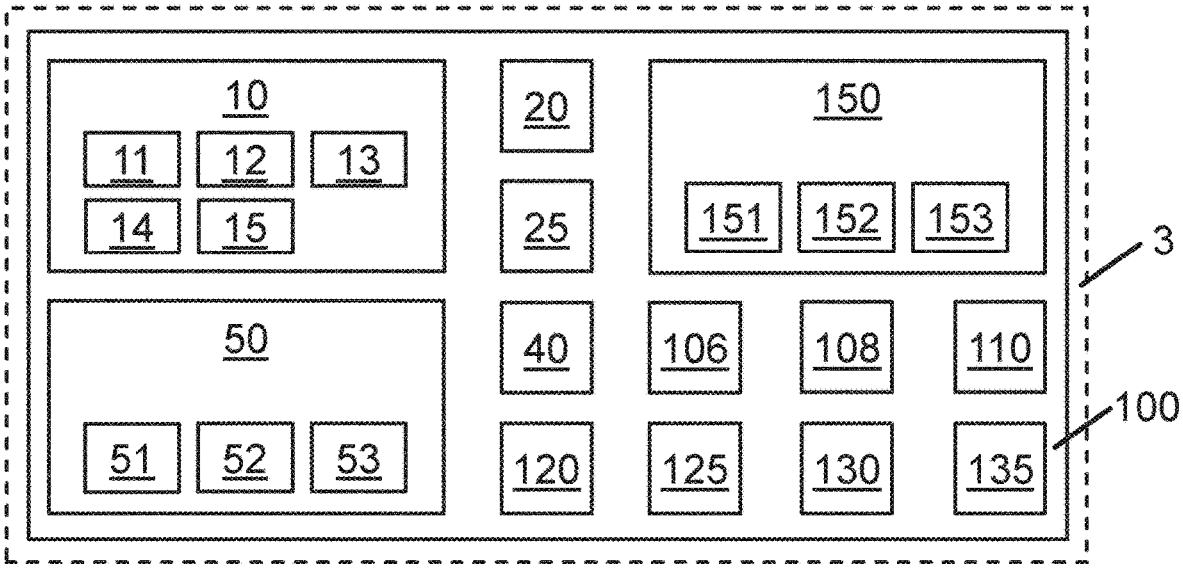

FIG. 3 shows a system 3 according to some embodiments. The system 3 includes the plurality of wear elements 10, the one or more sensors 20, the one or more power supplying devices 25, the control electronics 40, and the central control means 50. The system 3 also includes the machine 100 with the bucket 110 and control center 150 thereof. The control center 150 is provided with at least one processor 151, at least one memory 152, and a communications module 153 for wired and/or wireless data transmission and reception. The bucket 110 is coupled with a stick 108, in turn coupled with a boom 106.

In some embodiments, such as in the one of FIG. 3, the machine 100 is semi-automatic, i.e. it is operated by an operator with at least the assistance of the central control means 50 and the control center 150, or automatic, i.e. it is operated by the central control means 50 and the control center 150, and comprises computer vision means 120, first means 125 for detecting both position and orientation of the boom 106, second means 130 for detecting both position and orientation of the stick 108, and third means 135 for detecting both position and orientation of the bucket 110. The control center 150 may operate each of: moving means (not illustrated) of the machine 100 with the aid of the computer vision means 120, the boom with the aid of the first means 125, the stick with the aid of the second means 130, and the bucket 110 with the aid of the third means 135; also, the central control means 50 provide instructions to the control center 150 for adjusting the breakout force, the angle of attack of the bucket 110 or the trajectory of the bucket (each of which may be adjusted by operating the boom and/or the bucket 110), and/or for informing the operator (if any) of the machine 100 by commanding the provision of user perceptible signals or transmission of data indicative of: a status of the wear elements 10, computed force values, possible changes to the breakout force, angle of attack and/or trajectory based on the computations made by the central control means 50, etc. To this end, the control center 150 either transmits the data to a e.g. remote station by means of the communications module 153, or provides the user perceptible signals by way of user presenting means (not illustrated) of the machine 100, e.g. screen, loudspeakers, LEDs, vibrating devices, etc.

Figure 4:
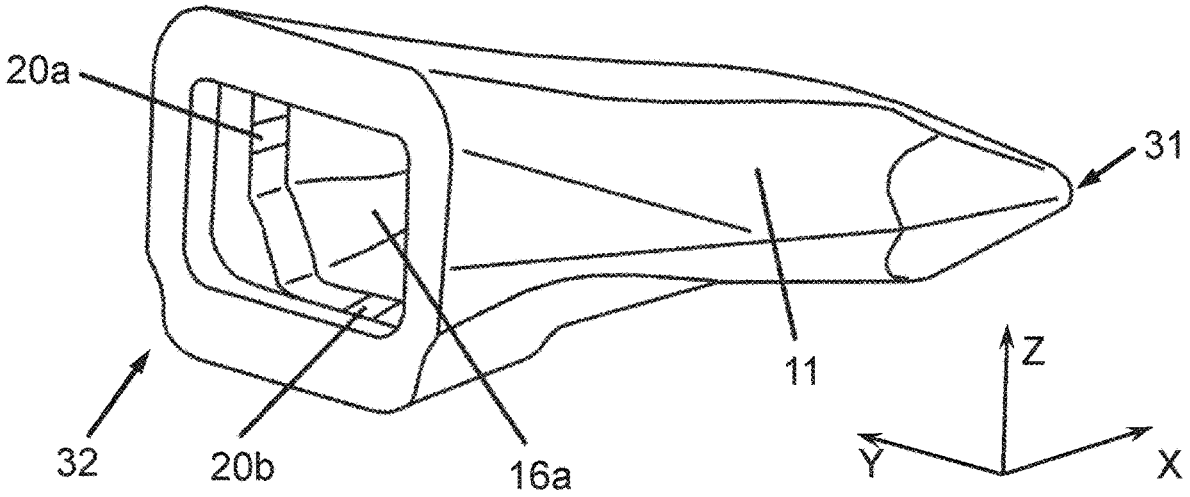
FIGS. 4 and 5 are a perspective view and a longitudinal section elevational view of a part of a system according to an embodiment that includes a tooth with sensors.
Figure 5:
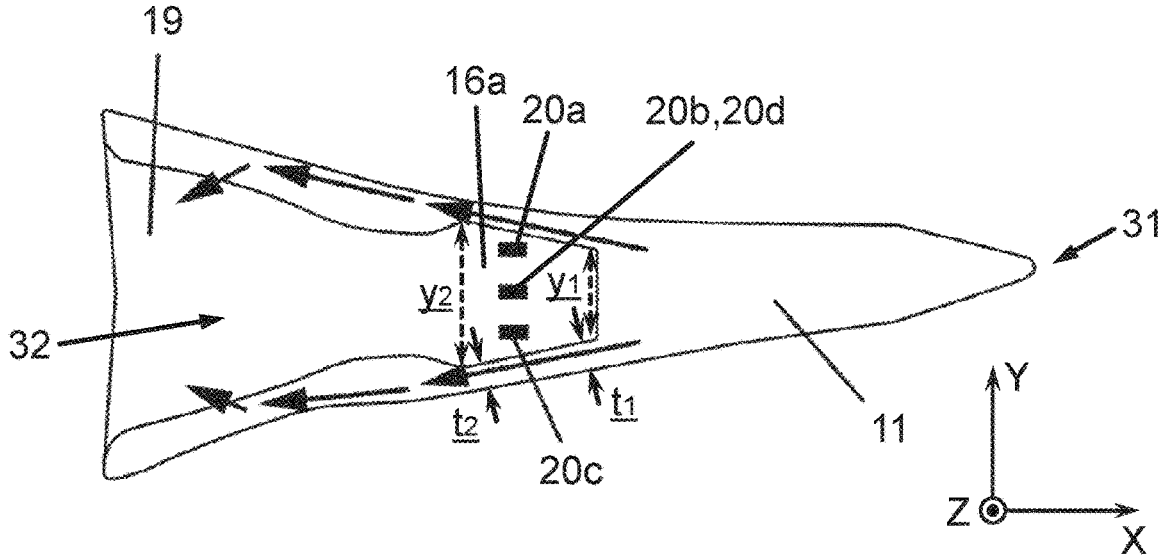

FIG. 4 shows part of a tooth 11 (in which the housing 19 shown in FIG. 5 is not represented) as a wear element of a system according to an embodiment, whereas in FIG. the tooth 11 is shown in its entirety. The tooth 11 has a first end 31 adapted for ground engaging during excavation operations as known in the art (hereinafter referred to as front part), and a second end 32 (hereinafter referred to as rear part) adapted for receiving a tooth bar (as shown for instance in FIGS. 6-7) that supports the tooth 11 so that it may remain attached to a bucket of an earth moving machine (as shown for instance in FIGS. 25A-25C).

The tooth 11 comprises a cavity 16*a* formed on the side of the second end 32, i.e. on the side where the tooth bar is received. The cavity 16*a* is a region that is open from said side, and said region is free from the tooth bar upon attachment thereto, that is to say, the tooth bar does not reach said cavity 16*a* once installed. Within said cavity 16*a* one or more sensors 20*a*-20*b* are arranged for measuring forces that the tooth 11 is subjected to, the most significant ones usually being during excavation and load operations whereby, ideally, the first end 31 engages the ground, something that ultimately depends upon: the digging force, the trajectory of the bucket, the angle of attack of the bucket, the arrangement of the wear elements on the blade thereof, and the geometry of the wear elements.

In this embodiment, within the cavity 16*a* are arranged four sensors 20*a*-20*b*, two of which are not seen due to the perspective of the tooth 11. The four sensors 20*a*-20*b* are arranged such that each one of them is attached to one of the walls delimiting the cavity 16*a* according to the Y and Z axes illustrated; in this sense, the measurement of force is preferably made at a point that is as close as possible to where said force is withstood. When the sensors are arranged in these locations, the strains or unitary deformations applied to the tooth 11 are measurable over a considerable portion of the structure of the tooth 11 as the magnitude and components of the strains or deformations on each of the sides usually differs from the magnitude and components of the strains or deformations on the other sides. This, in turn, provides richer amount of real data that can be used to calculate the force the tooth 11 (or other wear element in those embodiments in which the sensor or sensors are arranged in a different wear element) is subjected to.

In other embodiments, one or more sensors or each sensor 20*a*-20*b* are arranged in the wall delimiting the cavity 16*a* according the X axis illustrated; said wall is usually flat, thereby simplifying attachment of the sensor thereto.

The one or more sensors 20*a*-20*b* are e.g. strain gauges, which can be flat or cylindrical, pressure gauges, relative displacement gauges, optical fiber strips, piezoelectric strips or pressure sensors.

As it is known in the art, according to Hooke's law, stress relating to force and stress relating to voltage are linked because both have their own lineal proportionality which can be determined and linked mathematically under one and the same constant of proportionality. Thus, under a given deformation in the sensors 20*a*-20*b*, for example, strain gauges, the voltage varies, and the force that the tooth 11 has received can be determined, subject to calibration.

For the sake of clarity only, hereinafter the X axis will be referred to as axial or longitudinal direction, the Y axis will be referred to as lateral or transversal direction, and the Z axis will be referred to as vertical direction; it is readily apparent that the axes and the names thereof could be defined differently without departing from the scope of the present invention.

As seen in FIG. 5, the tooth 11 has the cavity 16*a* connected with a housing 19 that houses part of a tooth bar upon attachment to the tooth 11. As aforementioned, within said cavity 16*a* the four sensors 20*a*-20*d* (one of the sensors 20*d* overlaps another sensor 20*b* due to the section representation) are arranged on walls thereof, in particular in side walls, whereas in other embodiments one, some or all sensors are arranged in the front wall (i.e. the wall closest to the first end 31 and delimiting the cavity 16*a* with respect to the axial direction).

The cavity 16*a* has a tapered shape such that it is narrower in the part of the cavity 16*a* closer to the first end 31 (as shown with the width arrow $w_1$), i.e. front part, than the part of the cavity 16*a* closer to the second end 32 (as shown with the width arrow $w_1$), and a first thickness defined between the outer part of the tooth 11 and the cavity 16*a* being thicker in the front part than in the rear part (as shown with the thickness arrows $t_1$ and $t_2$).

The geometry of the cavity 16*a* formed in the tooth 11 (or that is formed in other wear elements as described later on) may be such that it takes into account both deformation and voltage so that the measurements can be sensitive enough, and at the same time not extremely sensitive so that the measurements are not to be confused with electronic noise. Accordingly, the geometry of the cavity 16*a* is also such that it is robust enough to withstand the working stresses typical of excavation procedures, and furthermore not exceed a maximum deformation limit, in which the sensors 20*a*-20*b* would be damaged due to the deformation, making impossible to take the measurements (this occurs when the elastic area of the materials of the sensors 20*a*-20*d* is exceeded, since they would be permanently deformed). Also, the geometry of the housing 19 can be modified with respect to housings when no cavity is formed so that the contact points are constant, in this way the distance between the application force and the reaction point does not vary because, otherwise, that could be a source of errors in the measurements that worsen the accuracy of the forces calculated based on the measurements.

Preferably, the sensor(s) is/are arranged in portions of walls whose thickness is substantially constant for more accurate and stable measurements.

Figure 6:
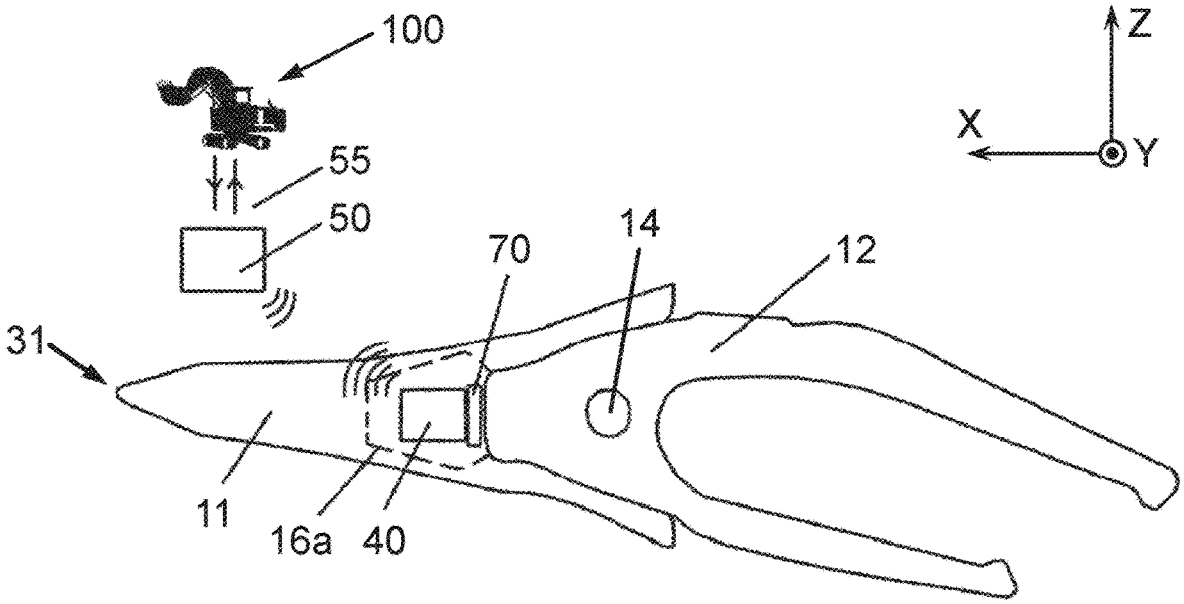
FIG. 6 is a longitudinal section elevational view of a system according to an embodiment that includes a tooth and a tooth bar assembly with sensors.

FIG. 6 shows a system according to an embodiment that, in addition to the sensors (not illustrated), comprises central control means 50, and control electronics 40 arranged within the cavity 16*a* formed in the tooth 11.

Figure 7:
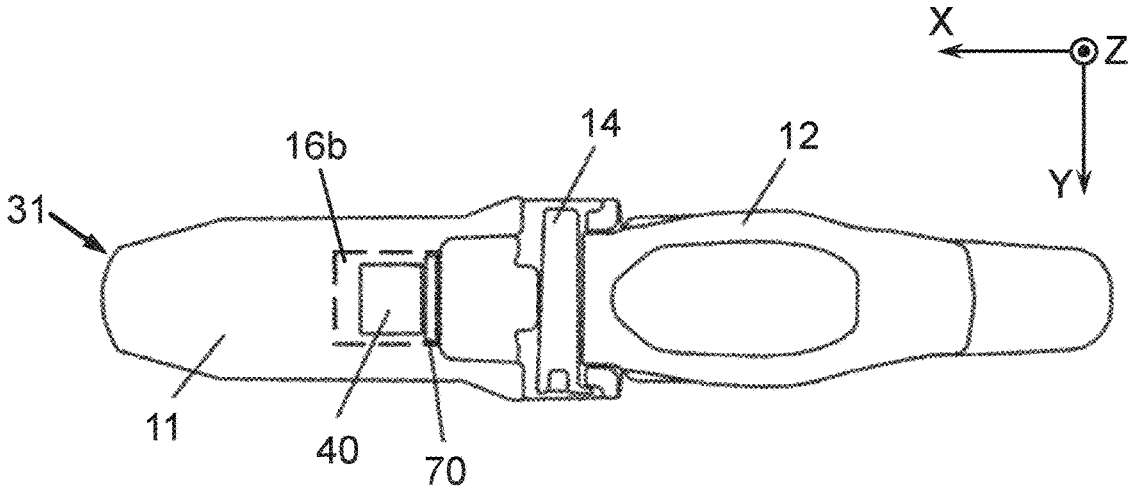
FIG. 7 is a longitudinal section plan view of a system according to an embodiment that includes a tooth and a tooth bar assembly with sensors.

In this example, a tooth bar 12 is shown attached to the tooth 11 once it is received within the housing of tooth 11. As also seen in FIG. 7 for example, a pin 14 secures the tooth bar 12 to the tooth 11. In spite of the introduction of the tooth bar 12 in the tooth 11, it can be observed by way of the dashed lines that the cavity 16*a* is free from the tooth bar 12 and, thus, can allocate components for measuring forces.

The control electronics 40 are connected to the sensors, either wirelessly or in wired form, and sends signals either wirelessly or by cable to the central control means 50, which in this embodiment are located outside of the wear elements 11-12 (for example in the cab of the machine 100). The signals include measurements of the sensors within the cavity 16*a*, thus the force or pressure exerted on the teeth 11 can be obtained in real time.

The central control means 50 calculate force values based on these measurements, and owing to the communication between the machine 100 (e.g. a control center thereof) and the control electronics 40 or sensors, any instructions 55 developed by the control center means 50 may be provided to the machine 100 for managing the work of the machine, and/or inform an operator thereof about any determinations made by the central control means 50. Also, the central control means 50 may send data to the sensors or the control electronics 40 thereof for commanding, for instance, activation or deactivation of the measurements, adjustment of sampling rates or transmission rates, etc.

In order to prevent accidental damage to the control electronics 40 and or the sensors within the cavity 16*a*, one or more elements for protecting them are preferably provided so as to isolate the components inside the cavity 16*a* against moisture, water and dirt. In this sense, a protective element in the form of a solid plate 70, for example, of metal, such as steel, is arranged in said cavity 16*a*, and/or the cavity 16*a* is coated with a protective substance, such as silicone or resin, thereby partially or completely filling up any free space within the cavity 16*a*. Furthermore, the control electronics 40 may be housed within a protective case resistant against hits and the ingress of particles that affect the correct functioning thereof.

FIG. 7 shows a plan view of a system according to an embodiment that is similar to that of FIG. 6, in which the tooth 11 has a different geometry and the cavity 16*b* formed therein is not tapered, but rather the side walls thereof (i.e. those delimiting the cavity 16*b* with respect to the Y axis)

have a constant thickness. In this plan view, the pin 14 mechanically coupling the tooth bar 12 with the tooth 11 is better seen than in FIG. 6.

The teeth 11 and tooth bars 12 of the systems of FIGS. 6-7 are of a size such that the tooth bar 12 is preferably welded to the blade of a bucket (not illustrated).

Figure 8:
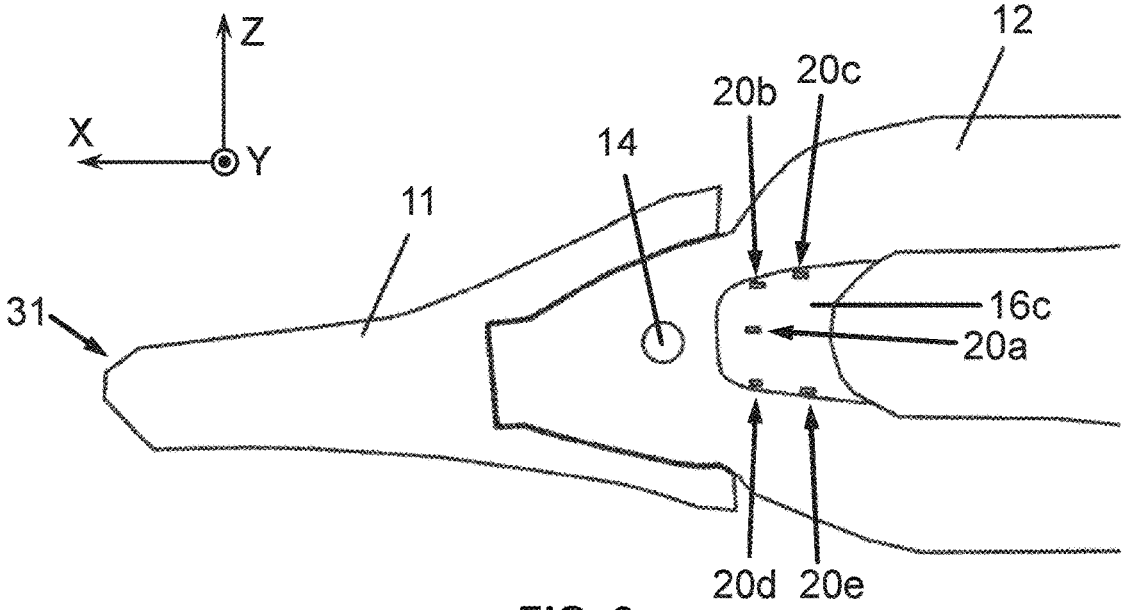
FIG. 8 is a longitudinal section elevational view of a system according to an embodiment that includes a tooth bar with sensors.

FIG. 8 shows a system according to an embodiment that includes a plurality of sensors 20*a*-20*e* within a cavity 16*c* of the tooth bar 12.

The cavity 16*c* is formed in a portion of the tooth bar 12 were it branches off into the two arms, between which the blade of a bucket is received and housed. Within the cavity 16*c* at least five sensors 20*a*-20*e* have been arranged such that two sensors 20*b*, 20*c* are arranged on a wall delimiting the cavity 16*c* in the vertical direction, two sensors 20*d*, 20*e* are arranged on an opposite wall delimiting the cavity 16*c* in the vertical direction too, and one sensor 20*a* is arranged on a wall delimiting the cavity 16*c* in the axial direction. Other arrangements and numbers of sensors are possible without departing from the scope of the present disclosure.

In this embodiment, the tooth 11 does not have a cavity formed therein because no sensors are arranged in the tooth 11, but in other embodiments sensors may be arranged in the tooth 11 in addition to the tooth bar 12, in which case a cavity may be formed in the tooth 11 as well.

Figure 9:
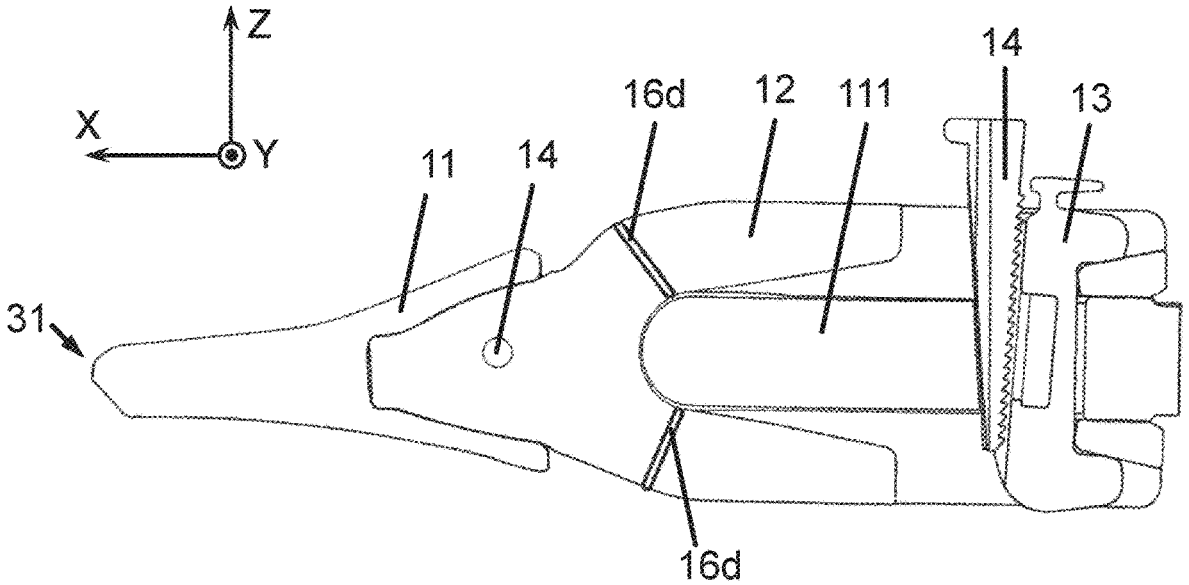
FIG. 9 is a longitudinal section elevational view of a system according to an embodiment with sensors at least in a tooth bar.

FIG. 9 shows a system according to an embodiment that includes one or more sensors within cavities 16*d* formed in arms of the tooth bar 12.

The tooth bar 12 is attached to the tooth 11 by way of a pin 14, and receives the blade 110 of a bucket between the arms of the tooth bar 12. The tooth bar 12 is mechanically coupled with the blade 111 by means of fixing elements 13, 14, which are a clamp 13 (in this case a C-clamp), and a wedge 14.

Figure 12:
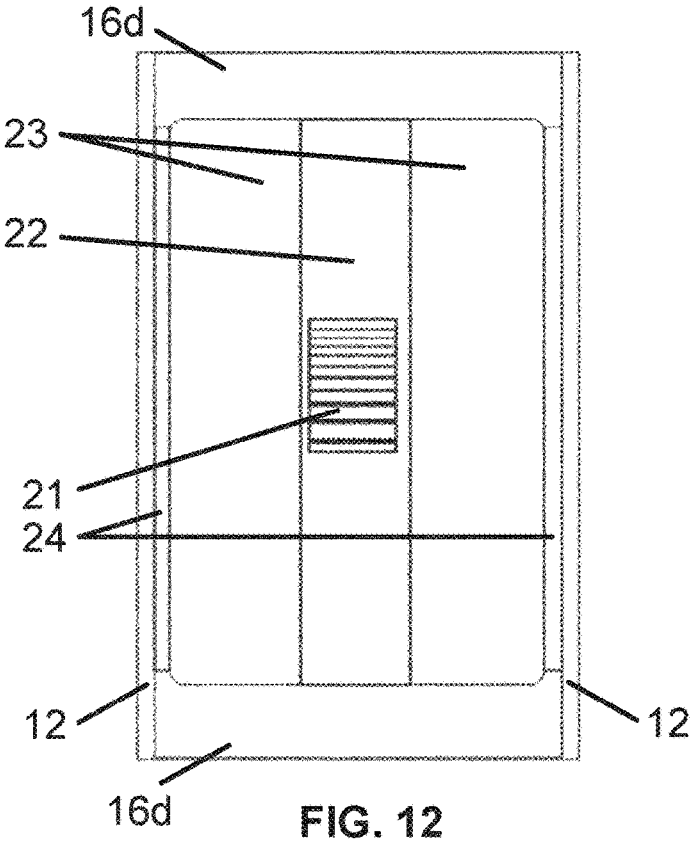
FIG. 12 diagrammatically shows a sensor for systems according to embodiments.

The cavities 16*d* are one or more through holes formed in each arm, and within which one or more sensors are introduced; an example of such sensor(s) is illustrated in FIG. 12. It has been found out that forming the cavities 16*d* in the portion of the arms closest to the location where the arms branch off provides a good trade-off between mechanical properties of the tooth bar 12 (to withstand the forces during ground engaging) and precision in the force measurements of the sensor(s). The diameter of these cavities 16 is preferably 10 millimeters or less, and greater than or equal to 2 millimeters, and the diameter is more preferably of 5 millimeters.

Figure 10A:
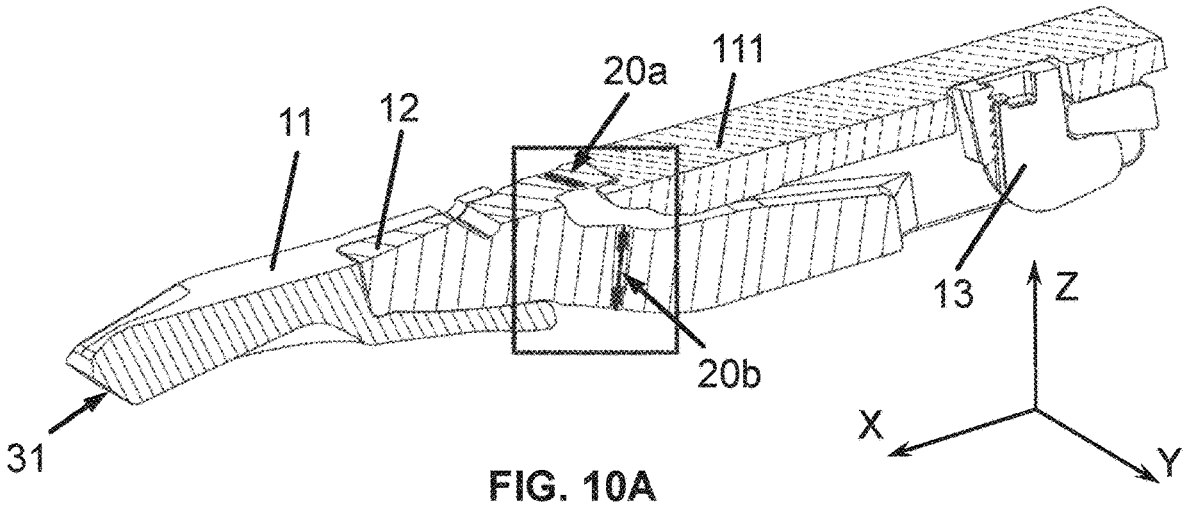
FIGS. 10A-10B and 11A-11B are perspective views of sections of systems according to embodiments with sensors at least in tooth bars.
Figure 10B:
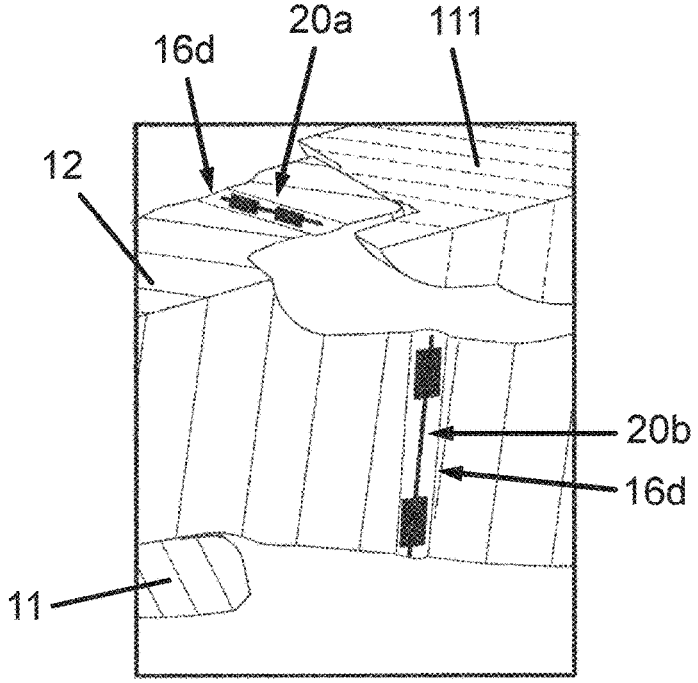

FIGS. 10A-10B show a system according to an embodiment similar to that of FIG. 9, where the cavities 16*d* are formed in the same portions of the arms as in the embodiment of FIG. 9, and also in the portion where the arms branch off.

Within such cavities 16*d* a sensor 20*a*, 20*b*, for instance in the form of a strain gauge (which is e.g. cylindrical), is introduced for measuring strains or unitary deformations of the tooth bar 12.

Figure 11A:
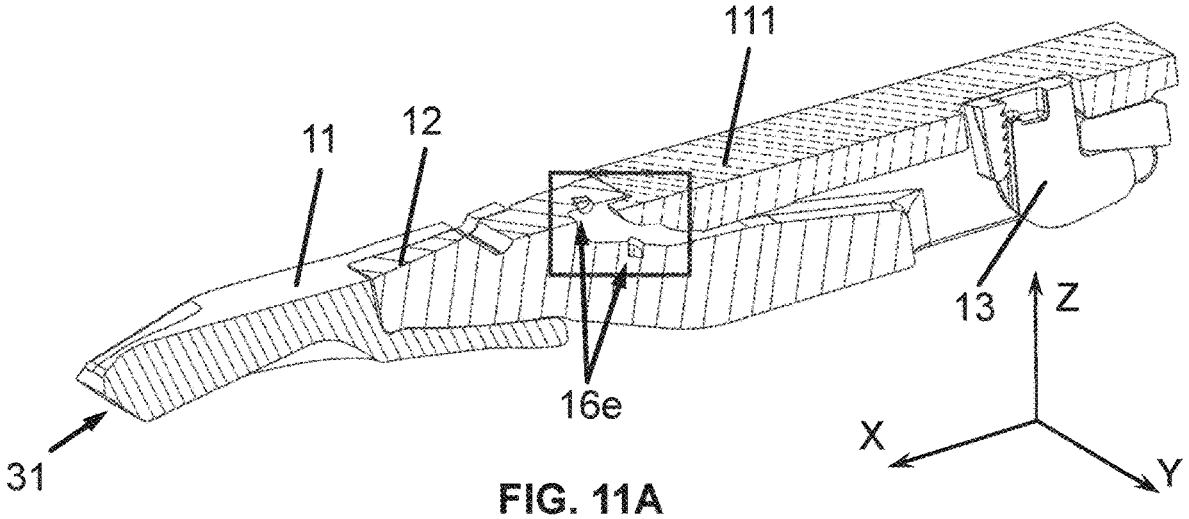
Figure 11B:
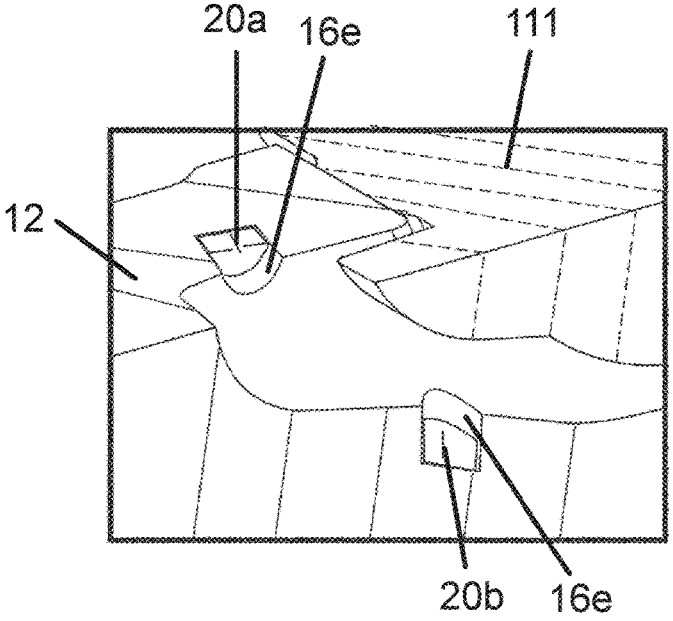

FIGS. 11A-11B show a system according to an embodiment similar to that of FIG. 9, where the cavities 16*e* are formed in the same portions of the arms as in the embodiment of FIGS. 10A-10B, and also in the portion where the arms branch off.

The cavities 16*e* are holes of a diameter preferably not greater than 25 millimeters, and more preferably within a range of 15 to 25 millimeters (both endpoints being included). These cavities 16*e* are not through holes, thus they only feature one opening. Within said cavities 16*e* one or more sensors 20, 20*b*, such as, but not necessarily, cylindrical strain gauges or relative displacement gauges are arranged for measuring forces.

FIG. 12 shows a section of a cavity, such as the cavity 16*d* of the embodiment of FIGS. 9, 10A-10B, with a strain gauge 21 introduced therein.

The strain gauge 21 is attached to a cylinder 23 made of e.g. steel that comprises a through hole 22 where the strain gauge 21 is introduced and attached.

In this example, the diameter of the cylinder 23 is of about 4 or 5 millimeters, and is less than the diameter of the cavity 16*d* formed in the tooth bar 12; the diameter of the through hole 22 in the cylinder is of about 2 millimeters. The cylinder 23 attaches to the walls of the cavity 16*d* by means of adhesive 24, for example, so that the cylinder 23 does not get out from the cavity 16*d* during operation of the machine incorporating the system.

The strain gauge 21 provides the measurements made to control electronics or central control means that are usually outside of the cavity 16*d* by way of a cable (not illustrated). In addition to transmitting the measurements, the cable prevents ingress of particles within the cavity 16*d* as it takes up at least part of the diameter of the hole of the cavity 16*d*, thereby reducing the probability of the sensor being damaged due to particles.

Figure 13:
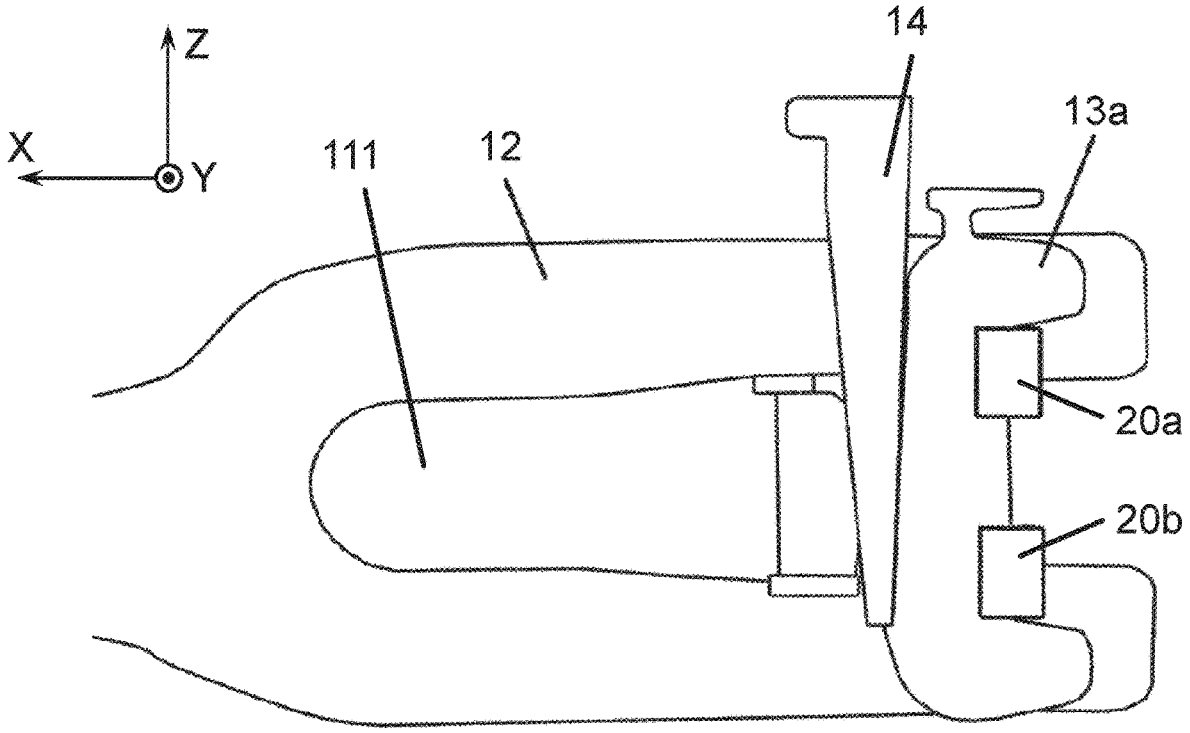
FIG. 13 is a longitudinal section elevational view of a system according to an embodiment with sensors between wear elements.

FIG. 13 shows a system according to an embodiment in which sensors 20*a*, 20*b* are arranged between different wear elements. In particular, the sensors 20*a*, 20*b* are arranged within a space between the fixing element 13*a* (a C-clamp) and the tooth bar 12.

From the measurements of the sensors 20*a*, 20*b*, the force withstood by the fixing element 13*a*, or by the tooth bar 12, or preferably by both, may be calculated.

Figure 14:
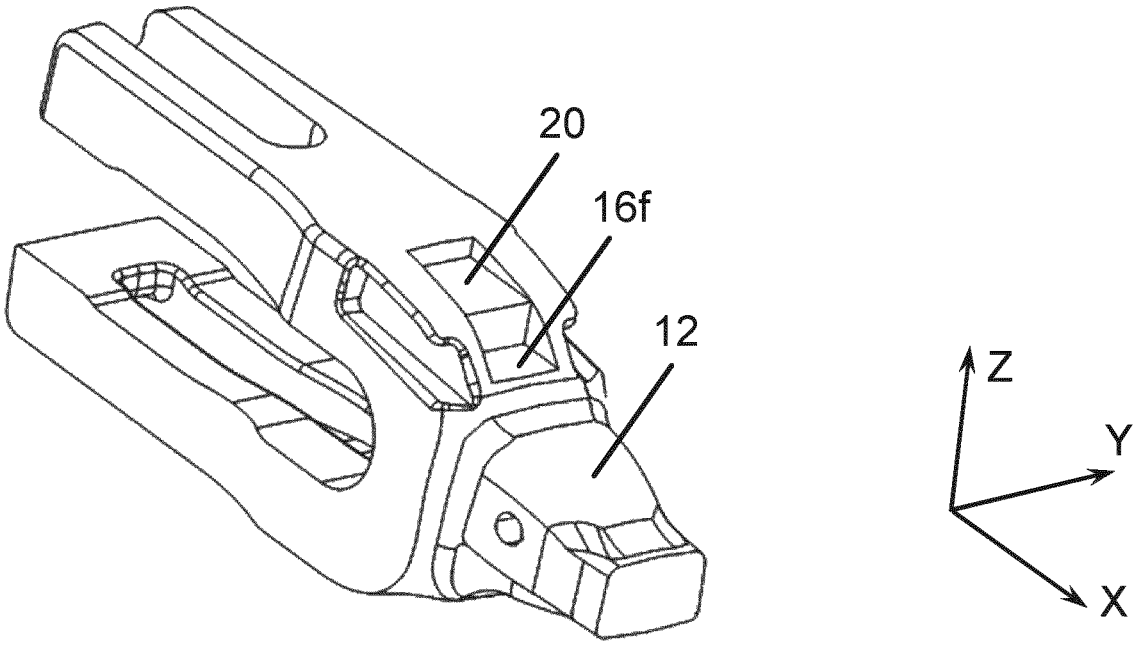
FIG. 14 is a perspective view of part of a system according to an embodiment with sensors at least in a tooth bar.

FIG. 14 shows part of a system according to an embodiment in which one or more sensors 20 are arranged on a sheet or case (in this example, a case is shown), said sheet or case being arranged in a cavity 16*f* formed in a side or arm of a tooth bar 12.

The cavity 16*f* is formed in a portion of an arm of the tooth bar 12 that is close to a location from where the two arms branch off. The cavity 16*f* is formed on the outer side of the arm, that is to say, on the side opposite to where the blade of a bucket is received.

The sheet or case is attached to the tooth bar 12 in the cavity 16*f* by means of either fixed attachment or releasable attachment. Concerning the former, the sheet or case can be attached by welding it to the cavity, or with adhesive, in which case it is preferred that the adhesive is as rigid as possible so that the forces applied to the cavity 16*f* are not lessened by the adhesive, something that would reduce the values measured by the sensor(s) 20. As indicated, fixing by means of releasable attachment is also possible by providing at least one threaded joint (preferably a plurality of such joints for reliably securing the sheet or case to the tooth bar 12); to this end, the cavity 16*f* is provided with holes for receiving the threaded joints.

By arranging the sheet or case in this fashion, the tooth bar 12 can be first mounted on the blade of the bucket, welded if necessary, and then the sheet or case with the sensors 20 is mechanically coupled with the tooth bar 12. In case of malfunction or failure of the components on the sheet or case (sensors, control electronics if any, power supply device or devices, etc.), replacing the same can be carried out without withdrawing the tooth bar 12 from the blade of the bucket.

Preferably, a protective case is attached to the sheet or case so that, if the tooth bar 12 is to be welded to the blade of the bucket for mechanical coupling thereof or the weld joints are to be desoldered, when said protective case (with the sheet or case therewithin) is already arranged in the cavity 16*f*, the same may avoid the damaging of the components due to high temperatures reached during the welding or desoldering tasks.

In some embodiments, both arms have such a cavity 16*f* formed therein so as to receive a sheet or case with one or more sensors 20, in this way the forces withstood by each arm can be computed.

Figure 15:
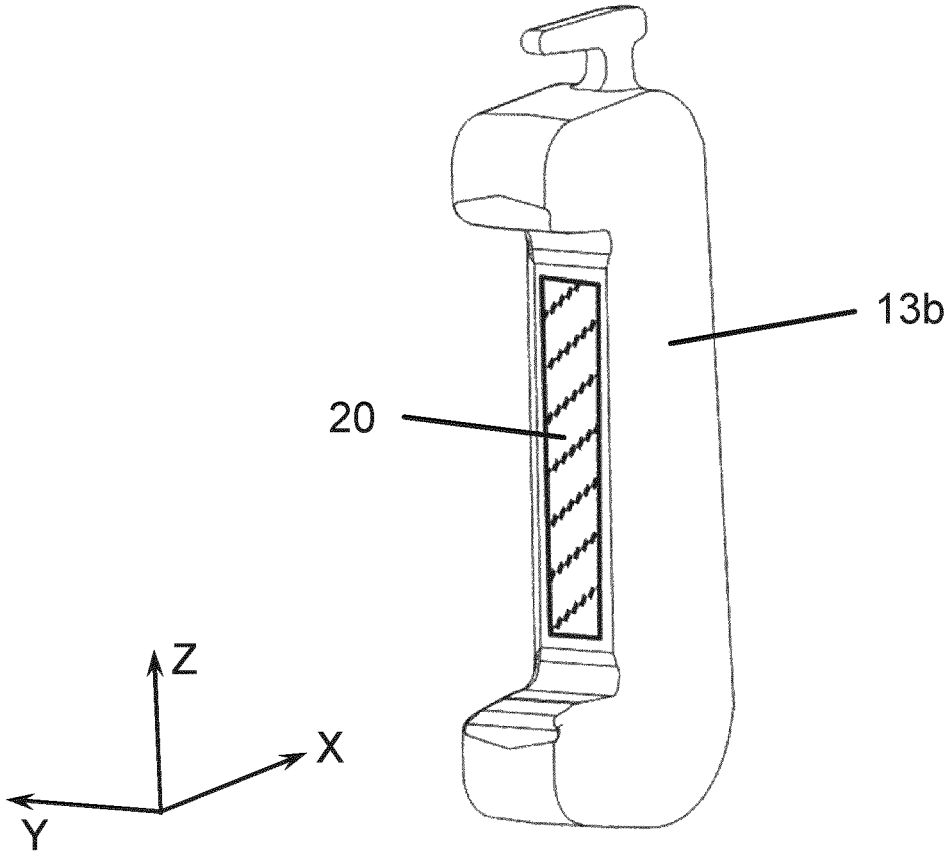
FIGS. 15-17 are perspective views of parts of systems according to embodiments with fixing elements in the form of clamps that have sensors.

FIG. 15 shows part of a system according to an embodiment in which a board 20 incorporating one or more sensors (not illustrated) thereon is attached to a fixing element 13*b*.

The fixing element 13*b* is a C-clamp for fixing a tooth bar to a blade of a bucket so that a welded joint needs not or cannot be provided, which is typically the case when the blade and/or the tooth bar is of large dimensions and a welded joint may not be reliable enough for operation of the machine.

The board 20 can be provided with control electronics in addition to the sensor(s) so that upon attachment thereof to a side of the C-clamp, the control electronics are already connected to the sensor(s).

Figure 17:
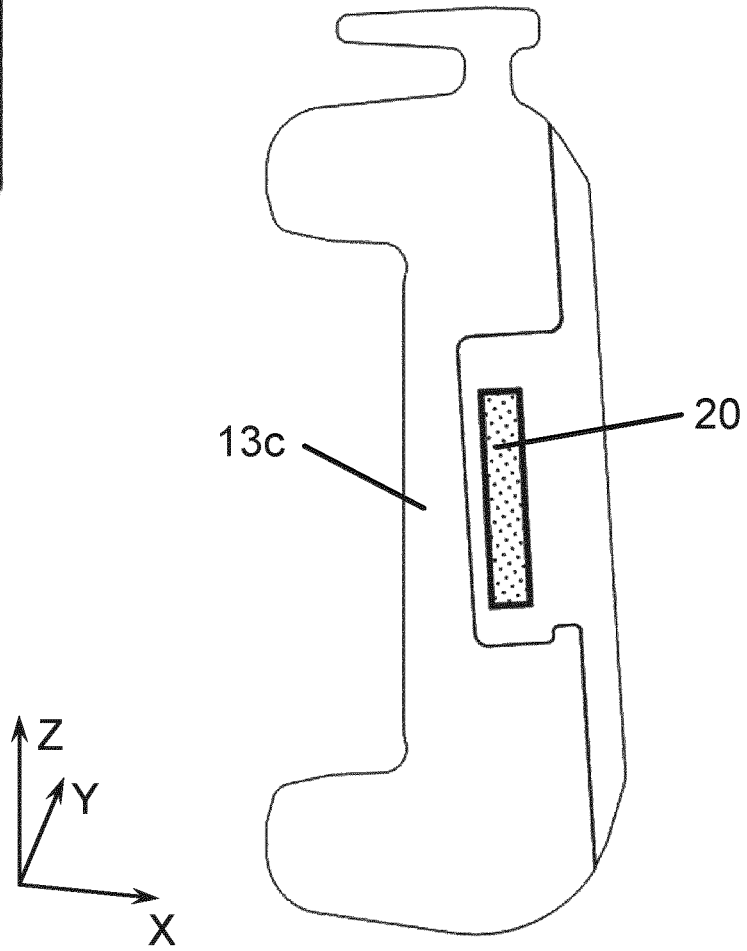

A similar arrangement of a board 20 is shown in FIG. 17, which shows part of a system according to another embodiment in which the C-clamp 13*c* is shaped such that it comprises a recessed portion. In the recessed portion an elastic component (not illustrated) is typically arranged for securing the mechanical coupling between the C-clamp and a wedge. The board 20 is arranged on a wall within this recessed portion, and the elastic component is still arrangeable in the recessed portion and on top of the board 20 so as to secure the mechanical coupling as aforementioned.

Figure 16:
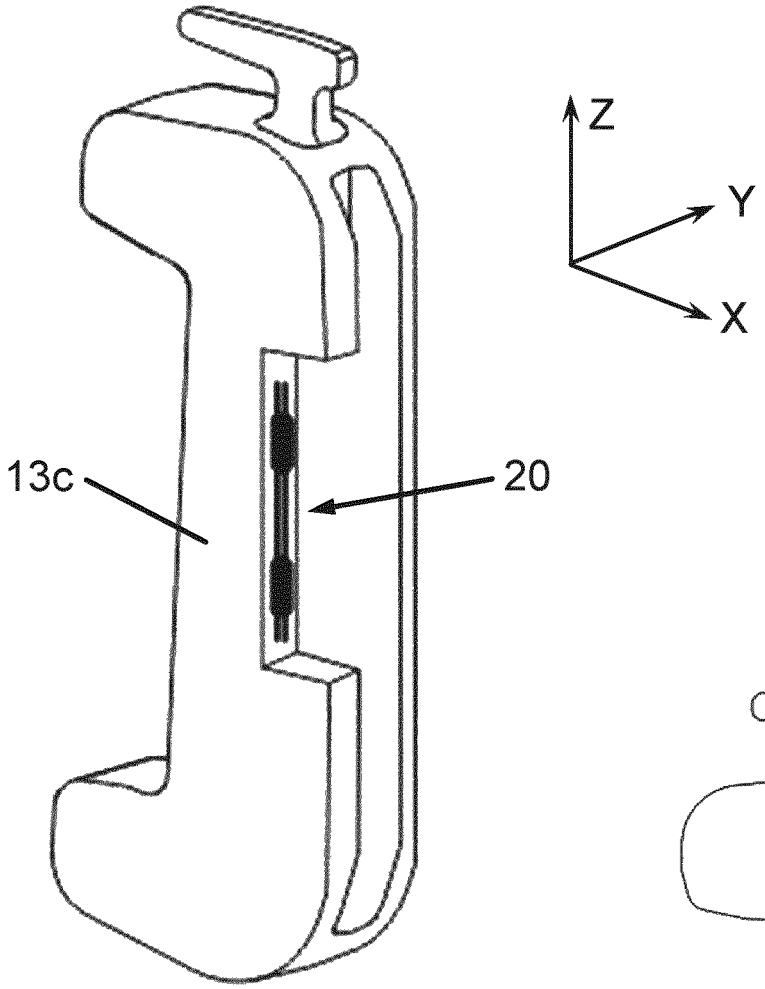

FIG. 16 shows a part of a system according to another embodiment in which a C-clamp 13*c* with recessed portion comprises a sensor 20 arranged thereon. In this case, a relative displacement gauge is attached to a side of the recessed portion.

Figure 18A:
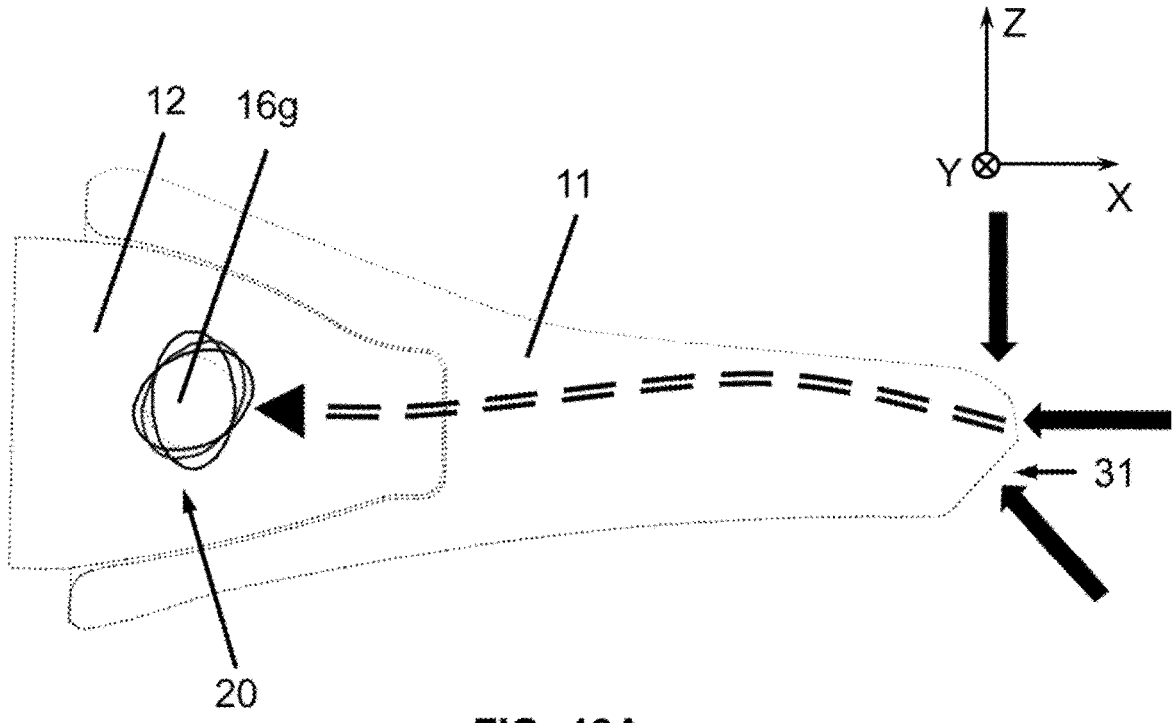
FIGS. 18A-18B show, from different views, a system according to an embodiment with sensors within a cavity in a tooth bar.
Figure 18B:
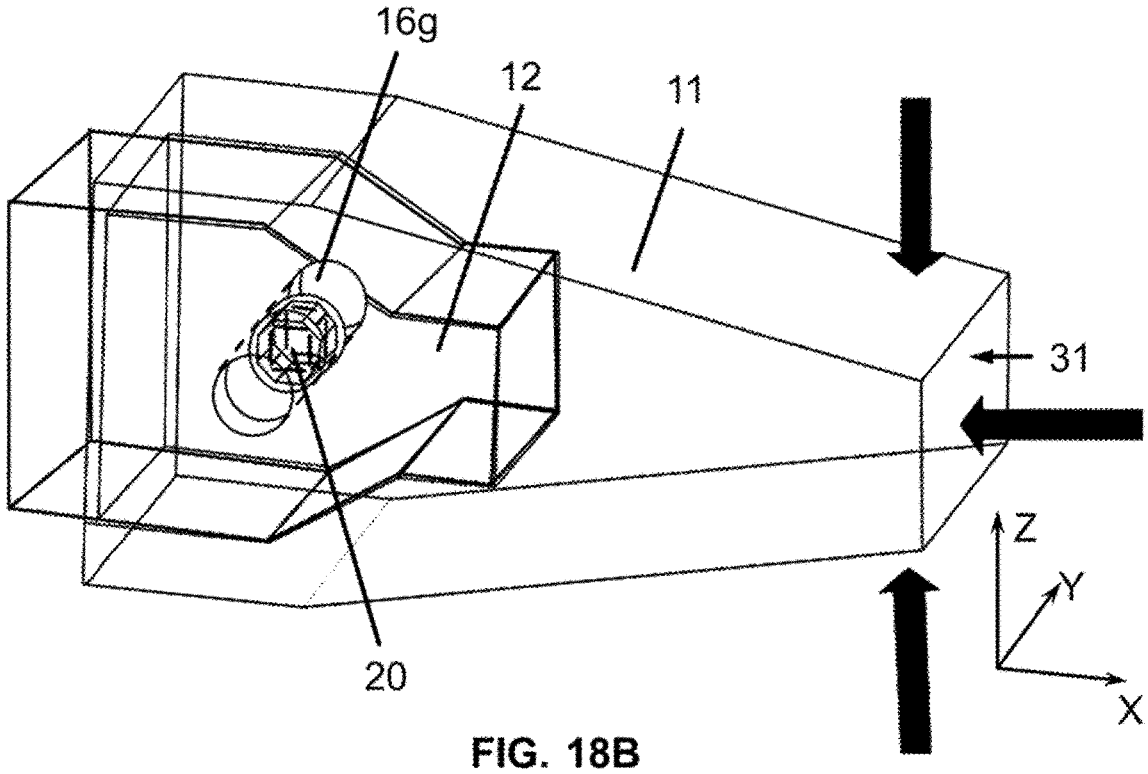

FIGS. 18A-18B show a system according to an embodiment in which a tooth bar 12 (only a portion thereof is illustrated) has a plurality of sensors 20 arranged therein.

Figure 18C:
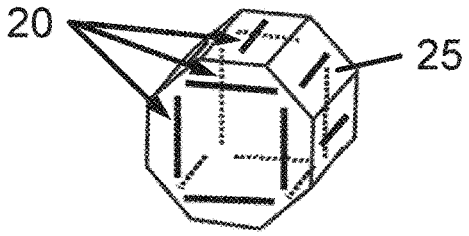
FIG. 18C shows a body with the sensors of FIG. 18B.

The sensors 20 are attached to different sides of a body 25 (illustrated separately on FIG. 18C). Said body 25 is precompressed and arranged within a cavity 16*g* of the tooth bar 12 adapted for receiving a fixing element, which mechanically couples the tooth bar 12 with a tooth 11 whenever the former is received in a housing of the latter. The sensors 20 are attached to the body 25, which in this example features the shape of an extruded hexagon that fits within the cavity 16*g*, but other shapes are possible as well without departing from the scope of the present disclosure, for example a cylindrical shape. The body 25 is made of a material having an elastic modulus that enables it to reproduce deformations undergone by the cavity 16*g*; by way of example, the body 25 may be made out of plastic, resin, aluminum, etc.

When force is exerted on the tooth 11 (as illustrated with the arrow extending from the first end 31 towards the other end of the tooth 11 and arriving at the tooth bar 12, said arrow being illustrated in a curvilinear form to denote the different directions with which the force can be exerted on the tooth 11 as also shown with the three straight arrows next to the first end 31), force is exerted on the tooth bar 12 thereby deforming the cavity 16*g* thereof as illustratively shown by way of a plurality of ellipses in FIG. 18A. Hence, the body 25 within the cavity 16*g* reproduces said deformation.

Depending on the deformation of the body 25, some sensors 20 or others will measure the strains or unitary deformations of the body 25, and the force values can be calculated from the measurements. In these cases, for example one pin may be introduced from each side of the cavity 16*g* for mechanically coupling the tooth bar 12 with the tooth 11, and the body 25 is arranged between the two pins.

In some other embodiments, the sensors 20 are attached to walls of the cavity 16*g* of the tooth bar 12, in which case the body 25 is not provided. In this way, the sensors 20 measure the strains or unitary deformations when the cavity 16*g* gets deformed. It is also possible to machine a greater diameter than that of the cavity 16*g* along the way thereof so that the sensors 20 are attached to the walls on that greater diameter, thereby not blocking the passage of the fixing element.

Figure 19A:
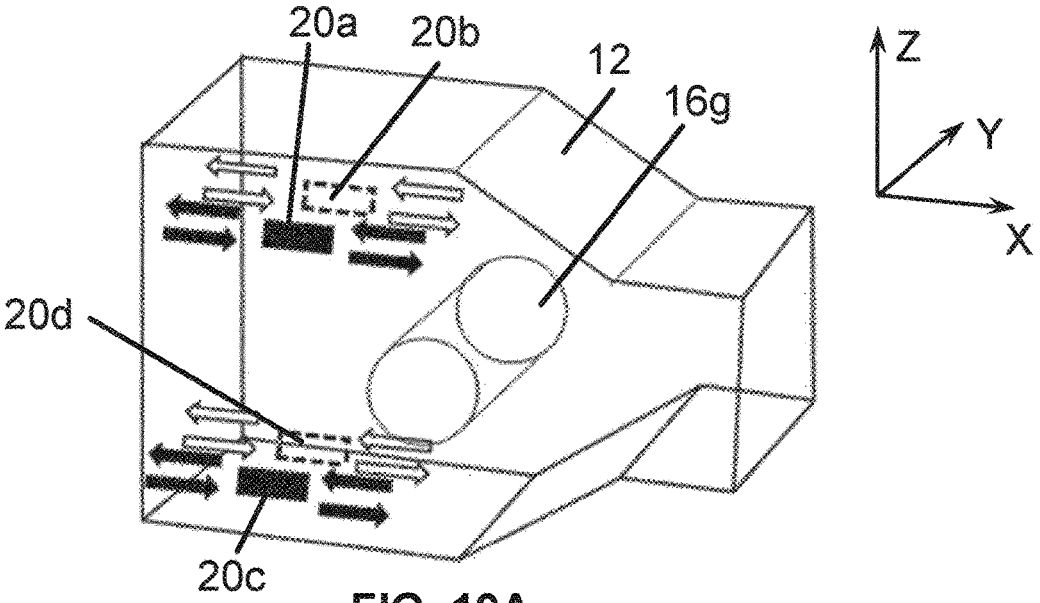
FIGS. 19A and 19B are perspective views of a tooth bar and a tooth of a system according to an embodiment with sensors at least in a part of a tooth bar to be received in the housing of a tooth.
Figure 19B:
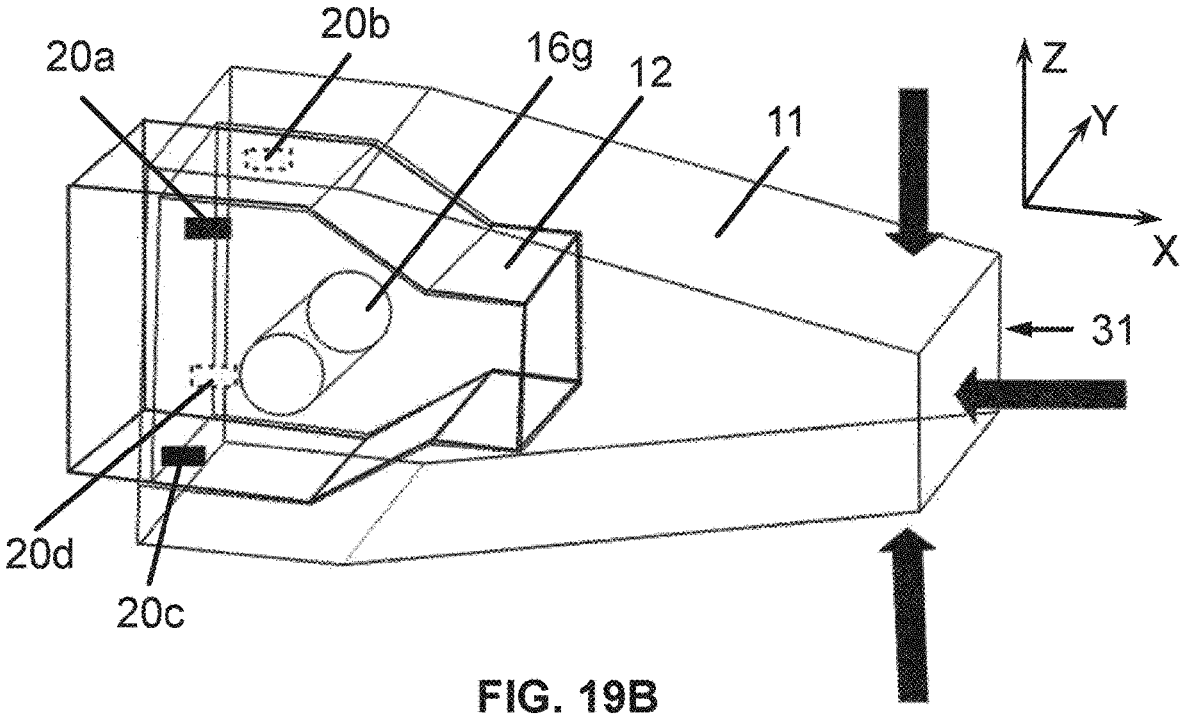

FIGS. 19A and 19B are perspective views of a tooth bar 12 and a tooth 11 of a system according to an embodiment.

In FIG. 19A only part of the tooth bar 12 is illustrated, in particular an exterior part of what is sometimes referred to as the nose of the tooth bar 12, which is the part received in a housing of a tooth (such as the housing 19 of FIG. 5). On different faces or recessed portions of the nose of the tooth bar 12, a plurality of sensors 20*a*-20*d* (two of which 20*b*, 20*d* are shown with dashed lines to illustrate that are attached to an opposite face of the tooth bar 12 and would be not visible otherwise) are arranged for measuring forces. In this sense, the sensors 20*a*-20*d* will measure the magnitude and directions of the deformations of the nose (as illustrated with arrows for the sake of clarity only).

The tooth bar 12 with the sensors 20*a*-20*d* is shown within the housing of the tooth 11 in FIG. 19B. It can be observed that the sensors 20*a*-20*d* are on the outer part of the tooth bar 12 that is within the housing of the tooth 11.

Although not illustrated, the systems described with reference to the examples of FIGS. 4-11B, 13-19B may comprise further components as per described, for instance, in FIGS. 1-3.

Figure 20:
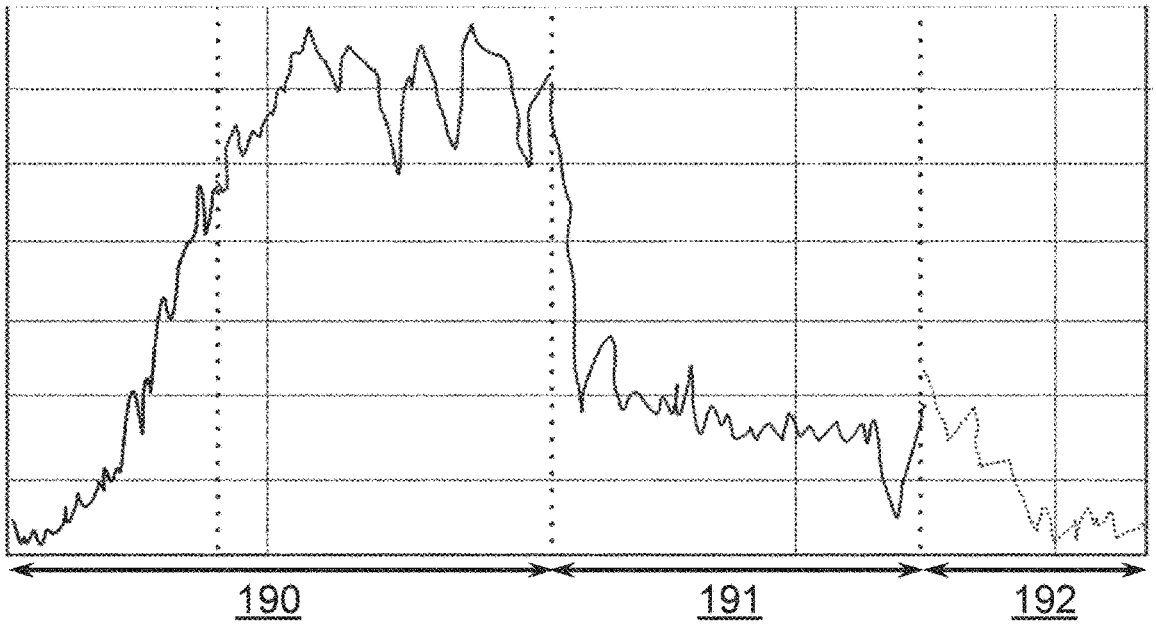
FIG. 20 shows a graph with a force measurement made with a sensor on the bucket of an earth moving machine.

FIG. 20 shows a graph that includes a force measurement of a sensor on the bucket of an earth moving machine during an entire earth moving operation.

The graph qualitatively shows the level of force whose magnitude measured with a single sensor on the bucket during: a charge 191 operation, a transport 192 operation, and a discharge 193 operation.

As it can be seen, the most demanding operation is the charge 191 operation, during which the machine and the wear elements may break if excessive breakout force is applied. It can also be appreciated that having a sensor on the bucket only provides magnitude of force values that may not be enough to determine the actual status of the wear elements or the machine, that is to say, there is no sufficient data to infer whether the wear elements and the machine are underperforming, overperforming, are about to suffer imminent failure, the earth moving operation is efficient, etc. Further, even though these data can be useful for operating the machine, they are not representative of the force exerted on the wear elements, which are the elements actually engaging the ground.

Figure 21:
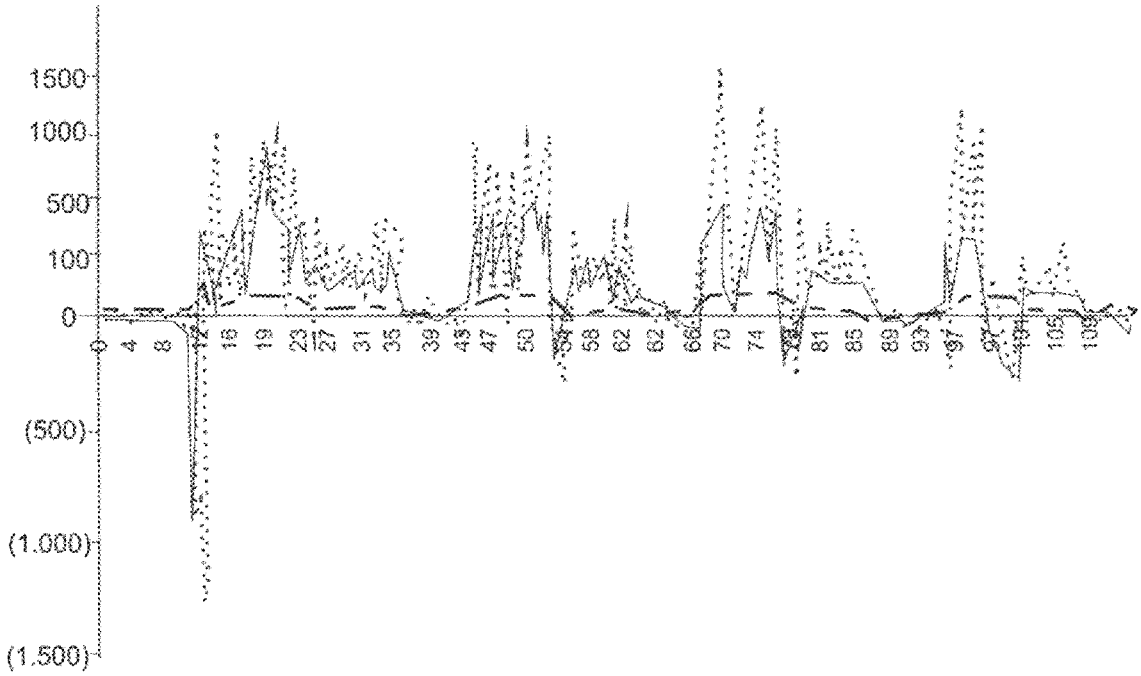
FIG. 21 shows a graph with a plurality of force measurements with sensors on a cylinder in the boom of a machine.

FIG. 21 shows a graph with a plurality of force measurements made with sensors on a cylinder in the boom of a machine.

The graph includes force measurements, in kilonewtons, corresponding to the vertical (illustrated with a dashed line) and axial (illustrated with a solid line) directions, and the magnitude of the resulting force measurements (illustrated with a dotted line).

Albeit force measurements of two different components can be provided with such sensors (corresponding to the X-Z plane), force measurements corresponding to the lateral direction are not provided, which are relevant for the status of components of the machine. Therefore, arranging sensors in a cylinder of the boom does not provide sufficient data to determine the status of at least the bucket and the wear elements.

Figure 22A:
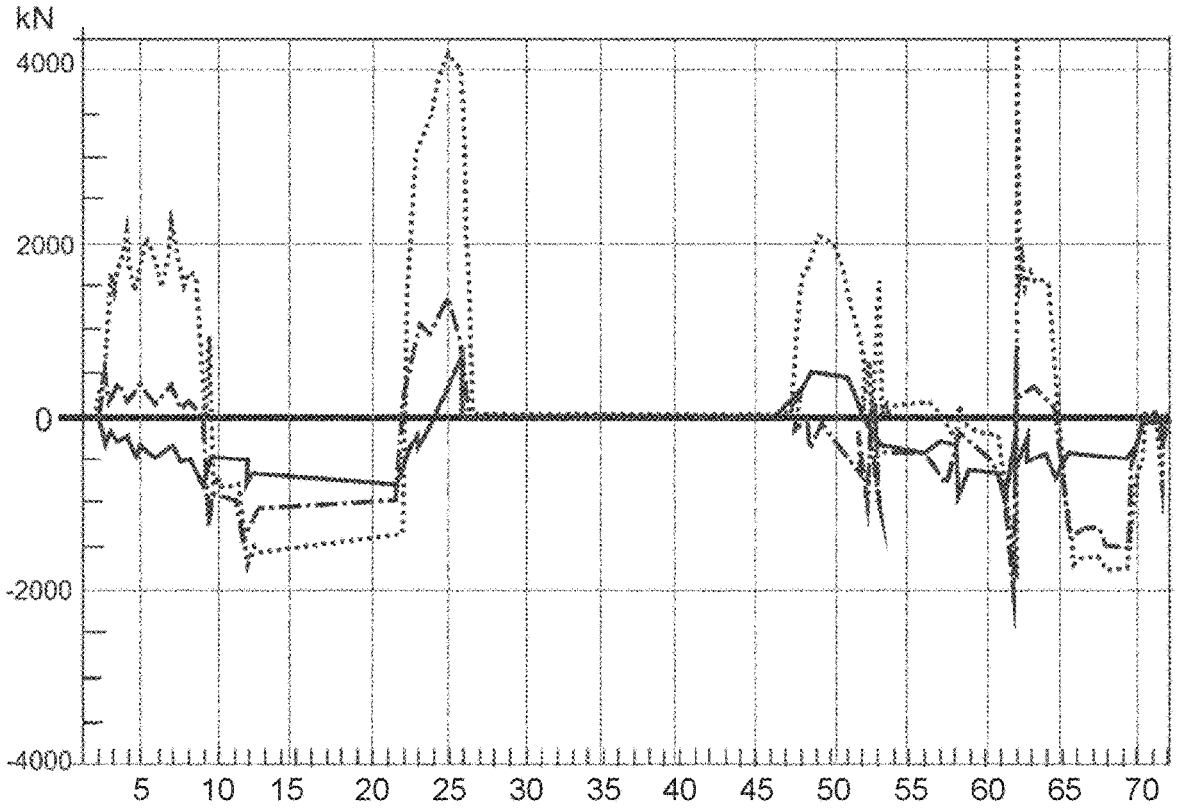
FIGS. 22A-22B show graphs with force values of two teeth of a system according to an embodiment.
Figure 22B:
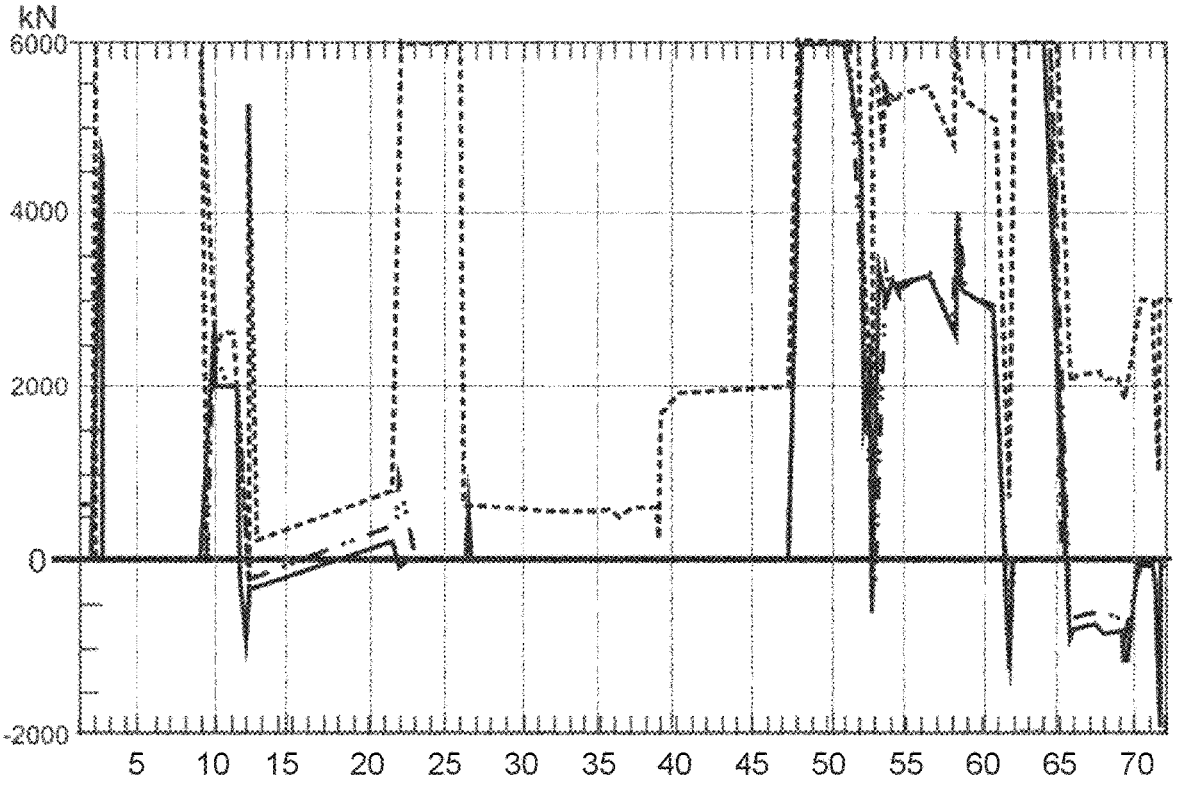

FIGS. 22A-22B show graphs with force values of two teeth of a system according to an embodiment; the force values have been plotted versus time.

The force values have been calculated by means of central control means of the system, which processed measurements of at least three sensors arranged in a first tooth of the wear elements, thereby providing force values for the first tooth according to the axial (dotted line), transversal (dash-dotted line) and vertical (solid line) directions as shown in FIG. 22A. The central control means also processed measurements of at least three sensors arranged in a second tooth of the wear elements so as to provide force values for the second tooth according to the axial (dotted line), transversal (dash-dotted line) and vertical (solid line) directions as shown in FIG. 22B. The first and second teeth of the plurality of wear elements are next to each other, that is to say, no other teeth were in-between them.

As it can be observed, in spite of the proximity of the two teeth, there are notable differences in the force values of a same component between the two teeth. In this sense, in the force values for the first tooth in the axial direction (which is at the edge of the blade) are, during some periods of times, three or four times smaller than respective values for the second tooth. Likewise, the force values for the first tooth in the vertical direction are, during some periods of times, about three times smaller than respective values for the second tooth.

The central control means, the control center of the machine, and/or an operator can use these force values for different wear elements, preferably in the three axes, to extract information regarding e.g. the reaction of the terrain with the different wear elements, which wear elements are being subjected to greater forces and in which direction, characteristics of the terrain being engaged (fragmentation, hardness, compactness, etc.), etc. This information, in turn, can assist the operator or enable the central control means or control center to determine: the trajectory followed by the bucket, the angle of attack that may be more suitable in the current situation, and/or the amount of force to be applied. Also, the monitoring of the force values over time also makes possible to determine whether any wear element is about to break, further characteristics of the terrain, energy consumption, etc.

Figure 23A:
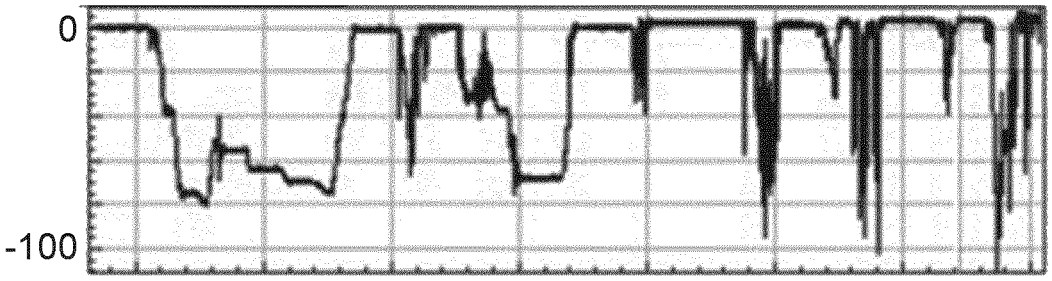
FIGS. 23A-23E show graphs with calculated forces and angles of the bucket by processing measurements of a system according to an embodiment.
Figure 23B:
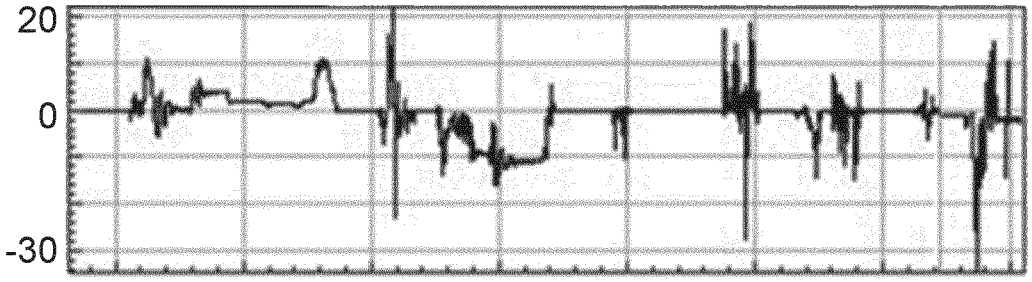
Figure 23C:
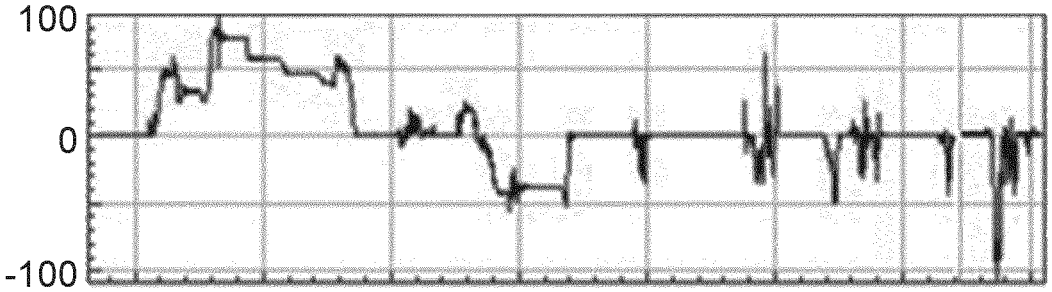

FIGS. 23A-23C show graphs with calculated forces, in kilonewtons, for a single tooth bar having sensors arranged therein. Particularly, FIG. 23A shows the force values corresponding to the axis direction, FIG. 23B shows the force values corresponding to the lateral direction, and FIG. 23C shows the force values corresponding to the vertical direction.

Figure 23D:
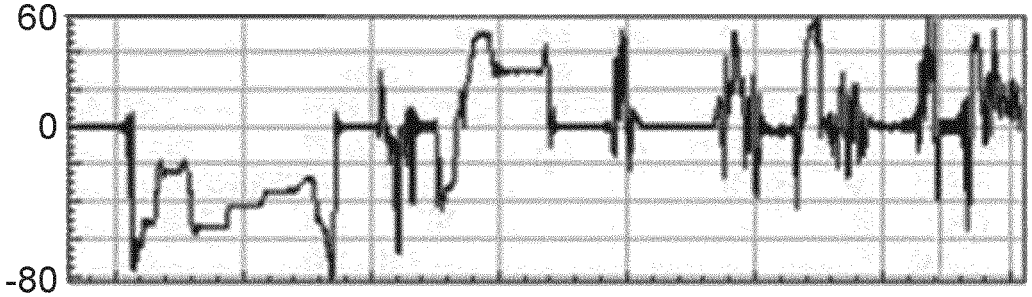
Figure 23E:
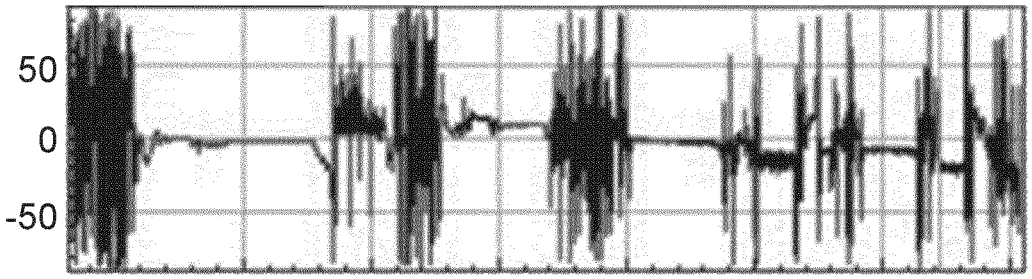

Also, FIGS. 23D and 23E show graphs with angles with which the force has been applied to the tooth bar according to the force values of FIGS. 23A-23C. This means that two different angles can be calculated from the force values and, upon combined processing of these angles, the direction of the forces can be determined. To this end, the angle values of FIG. 23D are the tangent angle of the force values in the axial direction divided by the force values in the vertical direction, whereas the angle values of FIG. 23E are the tangent angle of the force values in the axial direction divided by the force values in the lateral direction.

So not only the force values are calculated, but also the angle values. Moreover, the angle of attack may be defined, in some embodiments, as the tangent angle of the ratio of force values according to the axial direction over force values according to the vertical direction, thus as illustrated in FIG. 23D.

It is readily apparent that both sets of values can be used for determining whether too much force is being exerted on the wear elements and whether any corrective action needs be taken.

Figure 24:
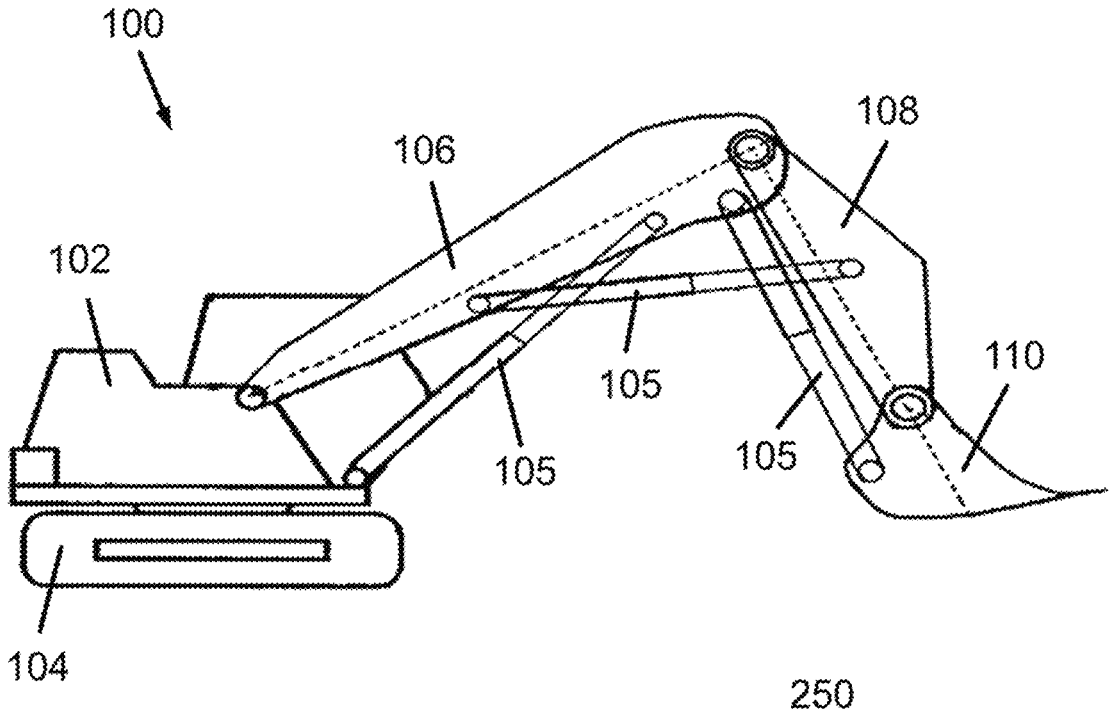
FIG. 24 shows an operator remotely controlling an earth moving machine having a system according to an embodiment.
Figure 24:
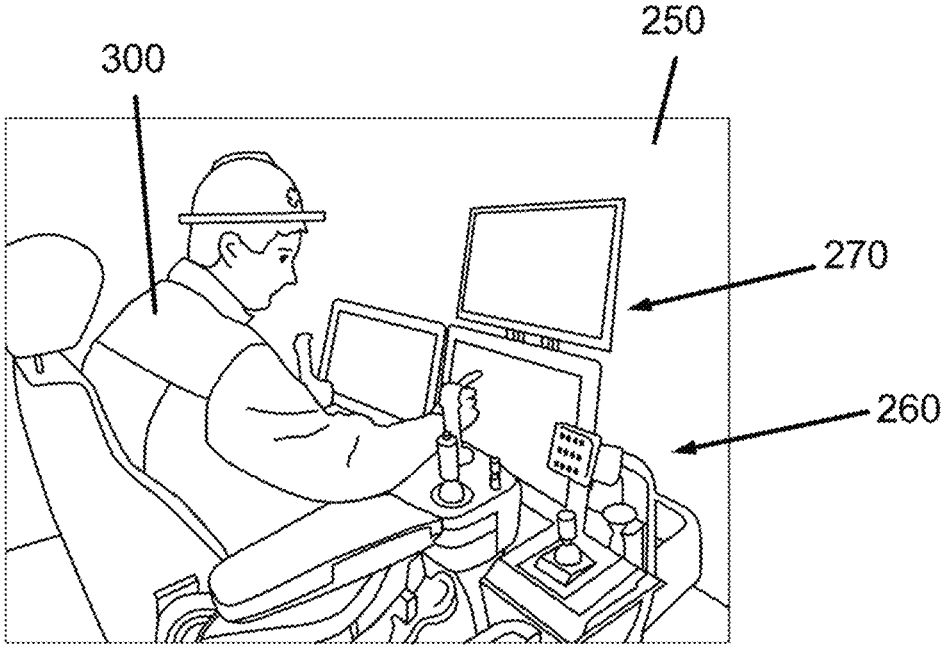

FIG. 24 shows an operator 300 remotely controlling an earth moving machine 100 having a system according to an embodiment.

The machine 100 is partially (i.e. semi-automatic) controllable with systems according to embodiments, but in some cases may be completely (i.e. automatic or autonomous) controllable with systems according to embodiments.

The machine 100 comprises a cab 102, moving means 104, a boom 106, a stick 108 coupled with the boom 106, and a bucket 110 coupled with the stick 108. Each of the boom 106, the stick 108 and the bucket 110 are moveable and rotatable by means of a hydraulic system that includes a plurality of cylinders 105.

The operator 300 is remote from the machine 100, in particular at a controlling station 250 provided with user input means 260 (e.g. joysticks, keyboard, buttons, etc.) and user presenting means 270 (e.g. screens, loudspeakers, LED indicators, etc.) The controlling station 250 transmits data to and receives data from the machine 100 by way of a wireless communication link. The machine 100 transmits data related to computervision means thereof, and means thereof indicative of the position and orientation of the boom, the stick and the bucket. The machine 100 may also transmit data related to the status of other components thereof, including but not limited to forces computed and/or instructions provided by central control means of a force measuring system incorporated in the machine 100.

The operator 300 is able to see that data owing to the user presenting means 270, and remotely control the machine 100 by way of the user input means 260. The controlling station 250 transmits the user instructions inputted via the user input means 260 to the machine 100, in particular to a control center thereof, which in turn runs the instructions as they are received, or are automatically adjusted based on the different data of the machine 100.

Figure 25A:
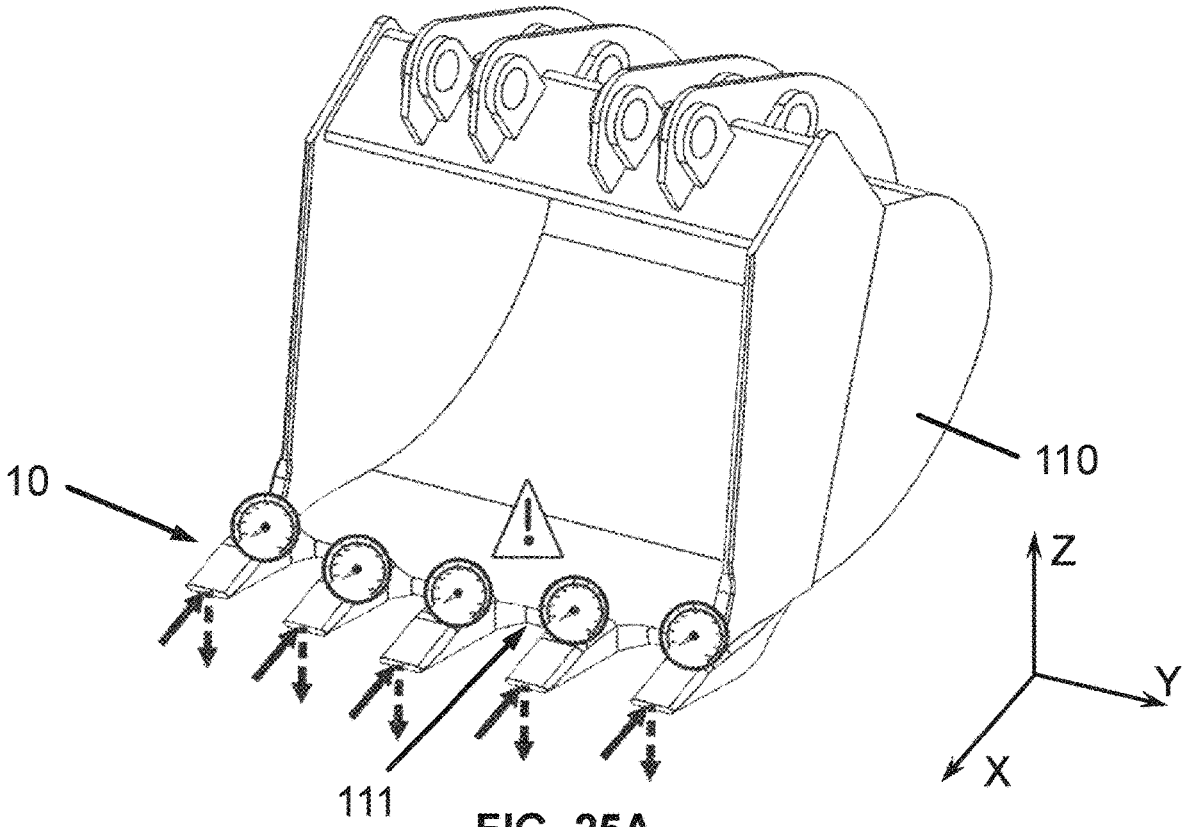
FIGS. 25A-25C show different examples of force exerted on a bucket or angles of attack as calculated with systems according to embodiments.
Figure 25B:
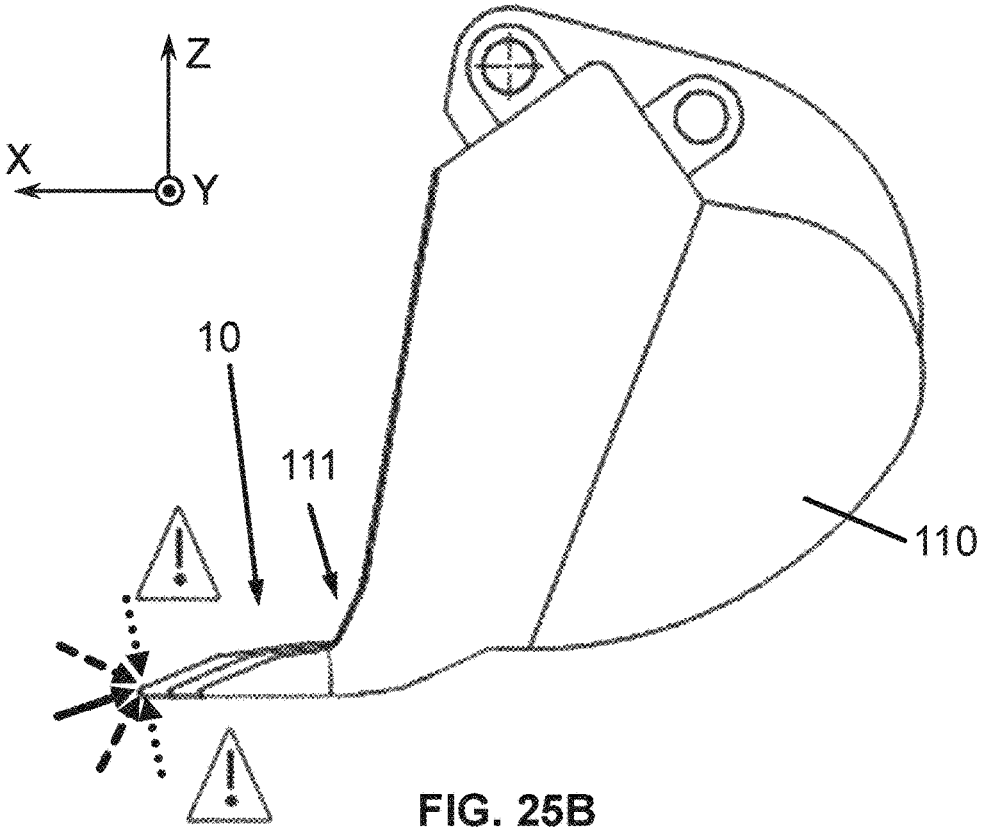
Figure 25C:
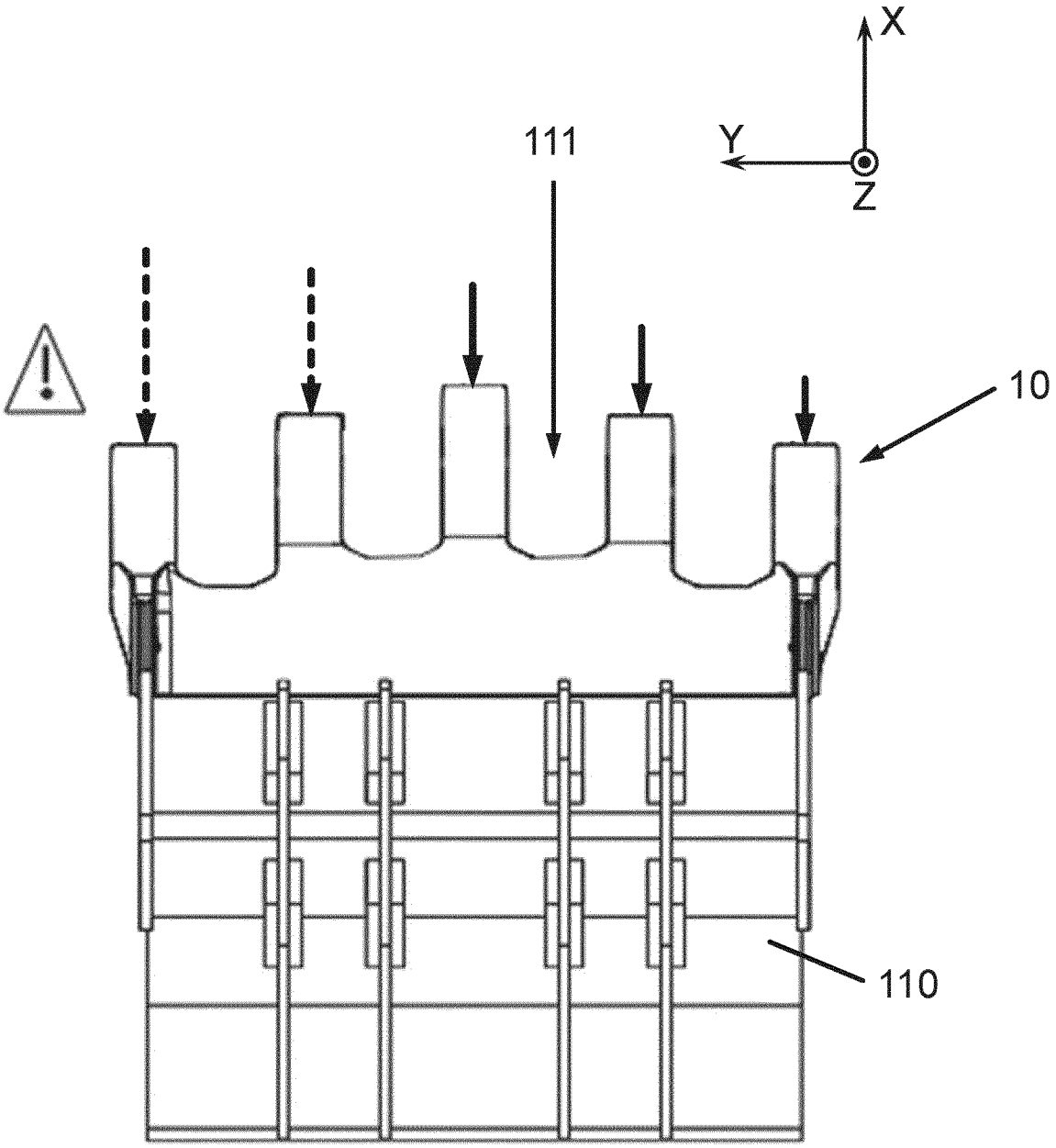

FIGS. 25A-25C show different examples of force exerted on a bucket 110 or angles of attack as calculated with systems according to embodiments.

As it can be appreciated from these figures, the existence of said system makes possible to detect how the ground exerts force on the different wear elements 10 (coupled with the blade 111 of the bucket) when the ground is engaged during excavation and load operations. At least one sensor is arranged in each teeth, tooth bar or fixing elements of the wear elements 10 that provide each GET, or between two of these wear elements 10 that provide each GET.

In this sense, FIG. 25A shows two different force components applied to all the wear elements 10 with similar magnitudes in each one of them. A first component (illustrated with a solid line) is along the axial direction and a second component (illustrated with a dashed line) is along the vertical direction. The force corresponding to the first component is not excessive according to a predetermined excessive force threshold set for forces according to the axial direction, whereas the force corresponding to the second component is excessive according to a predetermined excessive force threshold set for forces according to the vertical direction, thereby existing a risk situation (illustrated with an exclamation mark for the sake of clarity only). Hence, the central control means of the system, in addition to having calculated these forces based on the measurements of the sensors, can provide instructions in the form of a warning or a change in how the machine operates.

When a system for measuring force is not capable of calculating force for each of these components, the system could end up determining that there is no risk if, for example, the magnitude of the force calculated is less than a predetermined excessive force threshold set for magnitude values, but which is not representative of the resulting torque applied to the wear elements owing to the second component of the force, which is calculable with the present systems and methods. In addition to the calculation of forces in the three axes, the system of the present disclosure may enable (thanks to the measurements) estimation of RMS energy, angles that result in more stress applied on the wear elements, etc.

Turning to FIG. 25B, this example shows exemplary directions in which ground may engage the wear elements 10 and, based on measurements of the sensors, which angle of attack is calculated by the central control means of systems to be as the most effective for the excavation procedure or the least harmful for the wear elements 10, under the current set of conditions.

The central control means calculate that contacting the ground according to the solid arrow is the less harmful for the wear elements 10. Accordingly, should the ground be engaged as indicated with the dashed arrows, the wear elements 10 would become more damaged, thus lower BOF would be applied so as to avoid failure of the wear elements 10, yet the excavation procedure is going to be less effective as less material can be collected in this way. And even worse for the integrity of the wear elements 10 is that they engage the ground according to the dotted arrows, which result in a high risk of damaging the wear elements 10 at a greater rate (as illustrated with the exclamation marks).

Therefore, in accordance with the measurements, the central control means are capable of determining a preferred angle of attack. Albeit only arrows with the direction with which the ground is to be engaged by the wear elements 10, it is readily apparent that the angle of attack is defined by the angle formed between the arrow and the axial direction. Therefore, in this example, the preferred angle is approximately −15°, and a tolerable range of possible angles of attack with angles less preferred the farthest it deviates from −15° is approximately from −60° to 30°.

FIG. 25C shows another example in which the wear elements 10 engage ground with such an angle of attack that mainly forces along the X axis are exerted on the elements 10. However, the five teeth do not receive the force evenly. The teeth closest to the left side of the bucket 110 have a force applied thereto of greater magnitude than the teeth closest to the right side of the bucket 110; more particularly, each tooth has force exerted thereon with lower magnitude than the teeth that are at the left side thereof.

Accordingly, the first two teeth on the left side receive a force that is excessive in accordance with a predetermined excessive force threshold, whereas the three teeth on the right side (i.e. the middle one, and the two on the right) receive a force that is not excessive in accordance with a predetermined excessive force threshold.

It is readily apparent that a single sensor on the bucket 110, for example, would not be capable of detecting that an excessive force is applied on some teeth but not on the other ones. In fact, it may occur that the force calculated based on measurements of such single sensor are below a predetermined excessive force threshold and, thus, it is not detected that a risk situation exists.

In the example of FIGS. 25A-25C, five teeth are provided on the bucket 110, whereas in other examples the number of teeth is e.g. four, and more than five, in which case the number is typically smaller than twenty. For instance, in some examples, there are eight teeth arranged, ten teeth, fourteen teeth, fifteen teeth, etc. Also, the bucket 110 can have a different shape, and such that the blade 111 thereof is also differently shaped as known in the art.

Figure 26A:
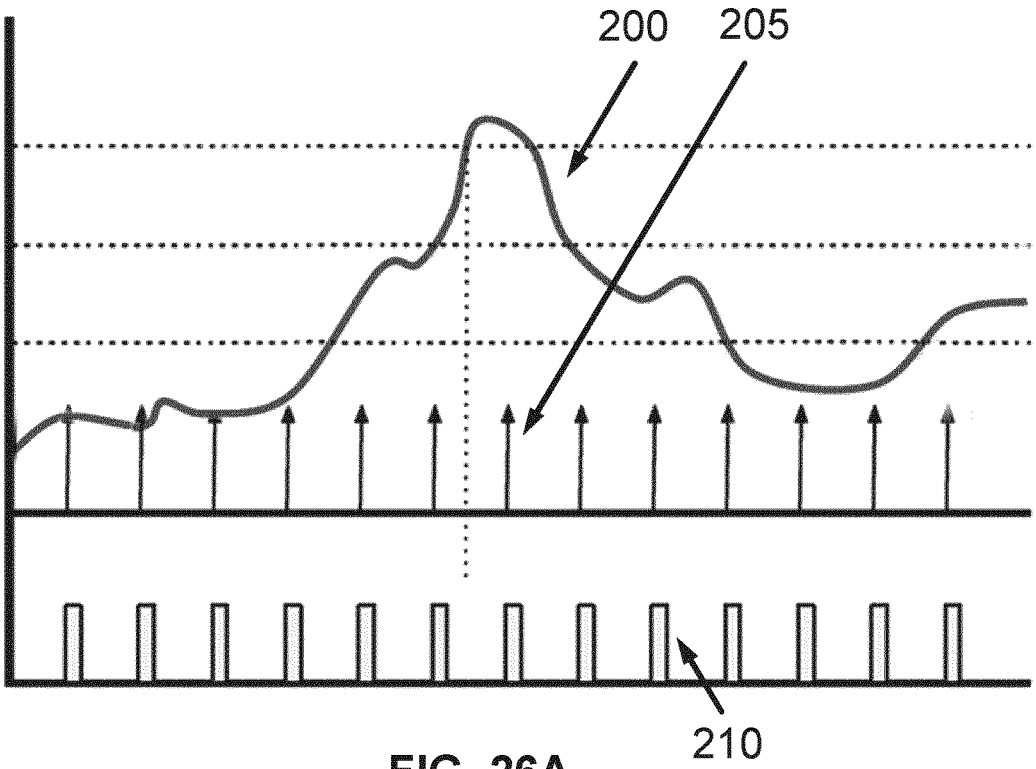
FIGS. 26A and 26B show graphs with two modes of operation of systems according to embodiments.
Figure 26B:
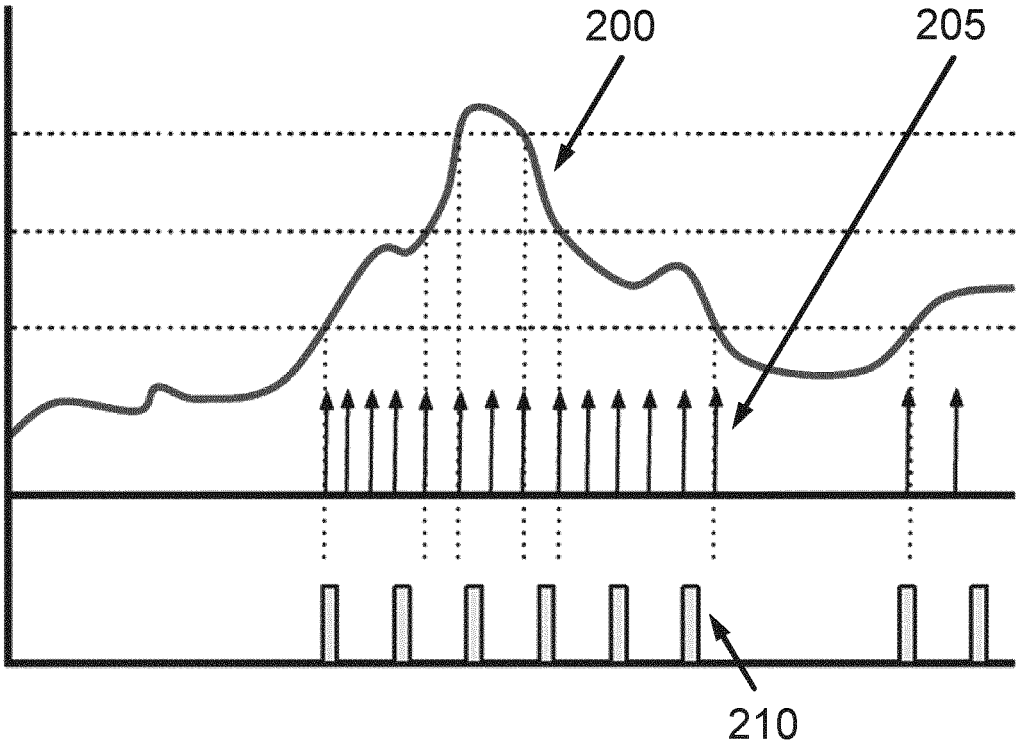

FIG. 26A show a graph with a first exemplary mode of operation of systems according to embodiments, whereas FIG. 26B shows another graph with a second exemplary mode of operation.

In the first exemplary mode, the sensor or sensors in wear elements continuously (i.e. analog operation) frequency measure strains or unitary deformations 200. Said measurements are sampled at a given frequency as shown with deltas 205. The sampled measurements are transmitted by the sensor(s) or control electronics to central control means at a given frequency as shown with pulses 210; each transmission consumes more energy than the sampling and, therefore, the useful life of e.g. battery or batteries is considerably influenced by the transmissions. The frequent transmission of measurements is carried out irrespective of the measured strain or unitary deformation 200, thus, for instance, it can be used to calculate force withstood by wear elements throughout the entire operation of the machine, which involves charge, transport and discharge tasks.

In the second exemplary mode, the sensor or sensors measure in the same manner, yet the sampling is carried out depending upon the measured strains or unitary deformations. When the measurements thus exceed certain threshold, which may be set as indicative of excavation and load operations or a considerable amount of force being applied to wear elements, the sampling is carried out at a greater frequency than in the first exemplary mode so as to gather more data about the operation that is in progress in order to warn an operator or adjust the way the ground is engaged for more efficient or less risky charging with the GETs. During these times, the transmissions 210 are made for computing the forces and provide output instructions whenever determined by the central control means according to the criteria set thereon. It is also possible to increase the transmissions 210 frequency based on the value of the measurements so that the greater the value of the measurements is, the greater the frequency becomes, and whenever the value of the measurements reduces, so does the frequency of the transmissions 210.

Figure 27:
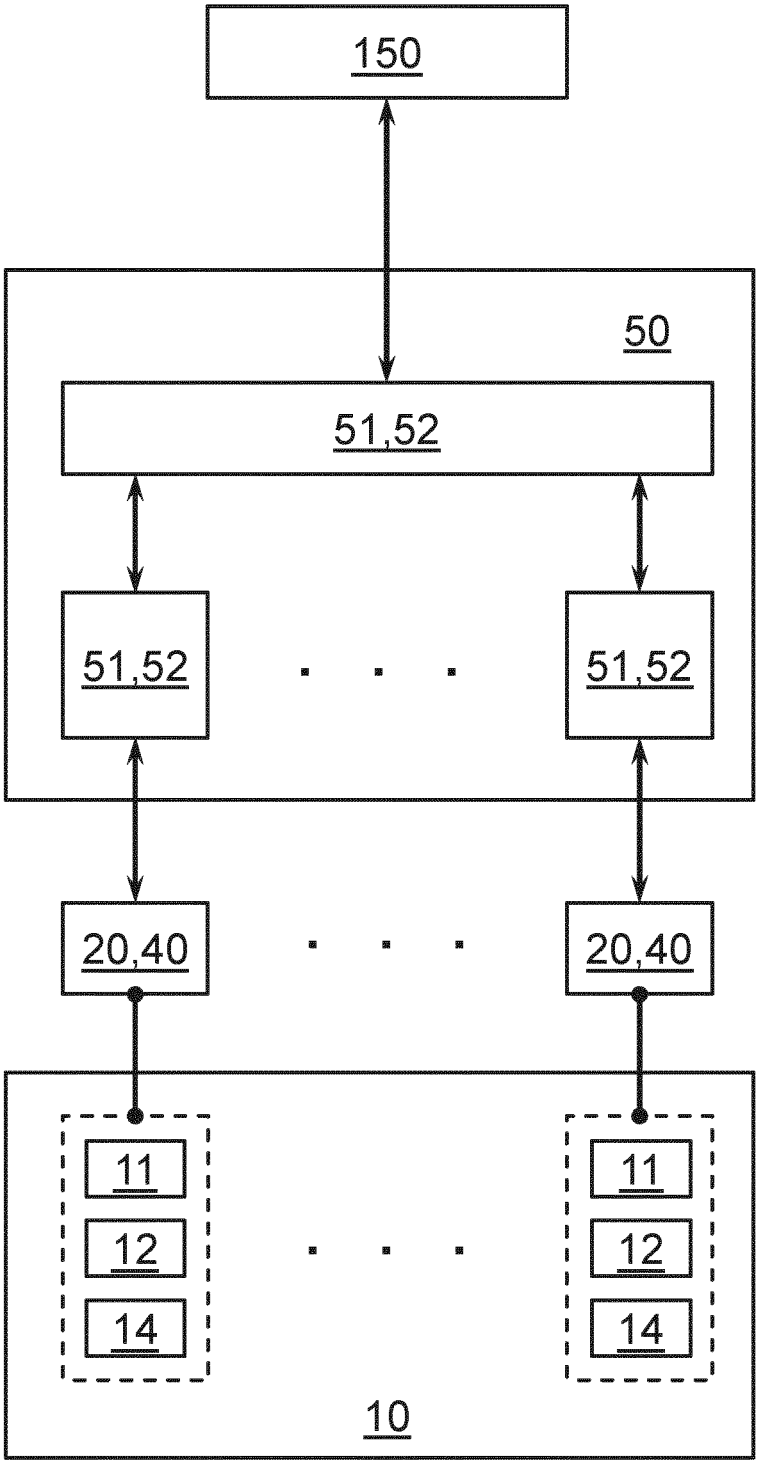
FIG. 27 shows, in block diagram form, exemplary processing by central control means of systems according to embodiments.

Both the first and second modes can be selectively used in the central control means of a same system so as to improve reaction times or gather data with different energy profiles. The second mode results in a greater power consumption during the charging that makes possible to have quicker response times, but may result in periods where no measurements are transmitted because the value of the measurements is low, whereas the first mode results in a homogeneous power consumption that makes possible to have information during the entire excavation procedure. By combining both modes, and adjusting the different frequencies thereof, the energy that can be provided by power supplying device(s) may last long times. FIG. 27 shows, in block diagram form, exemplary processing by central control means 50 of systems according to embodiments.

The systems at least comprise: the central control means 50, which include a plurality of processors 51, memories 52 and communications modules (not illustrated), a plurality of sensors 20, each of which preferably has control electronics 40 (one for sensor 20, or one for several sensors 20) connected thereto, and a plurality of wear elements 10. The control center 150 of a machine is part of the systems in some embodiments.

Each sensor or groups of sensors 20 measures strains or unitary deformations of a respective group of wear elements (in this case, tooth 11, tooth bar 12, and fixing element or elements 14). In this example are shown two groups of wear elements, but there may be one only, or more than two (as illustrated with dots).

One or more processors and memories 51, 52 of the central control means 50 process measurements of a sensor or group of sensors 20 so as to calculate forces withstood by respective wear element(s) 11, 12, 14. The force values are then provided to other one or more processors and memories (illustrated with the top-most block of central control means 50), which receive the force values corresponding to each wear element 10 so monitored and: provide them to the control center 150 as they are (the control center 150, in turn, may produce instructions at least based on these force values), and/or process all the force values to determine whether any wear element or elements 10 is underperforming or overperforming according to predetermined thresholds set therein and provide output instructions based on the determinations made, which are then sent to the control center 150.

In some embodiments, the other one or more processors and memories receive inputs from the control center 150 or other units of the machine, and process said inputs together with the force values so as to determine whether any corrective action may need be taken. In this sense, the inputs do not have to be limited to sensing data of components of the machine, but parameters of the machine or the operation may also be relevant for carrying out the calculations, for example: type of bucket of the machine or of the machine itself (that is to say, geometry, mass and/or dimensions thereof, etc.), type of terrain (type of material, hardness thereof, how compacted it is, etc.), breakout force, inertia information, etc.

Likewise, in some embodiments, the other one or more processors and memories store and/or receive historical data of calculated force values and other inputs of the machine in order to apply machine learning techniques during processing of force values of the GETs, thereby making possible to adjust the output instructions produced based on previous values that progressively enhance the results of the machine learning techniques. The historical data used in machine learning are preferably processed by means of tagging tasks whereby personnel reviews the data together with, for instance, logs registered by an operator or camera footage; in this way, the personnel classifies the different sets of data for supervised training, thereby enhancing the result of the classifications and outputs made by the machine learning techniques in subsequent excavation procedures.

The data computed by the central control means 50 can be used during operation of the machine itself, and also for ulterior analysis thereof so as to determine how the wear elements and the machine behaved, and whether other wear elements (e.g. size thereof, shape thereof, number of teeth, etc.) may be more suitable for the scenario in which the machine was.

Figure 28:
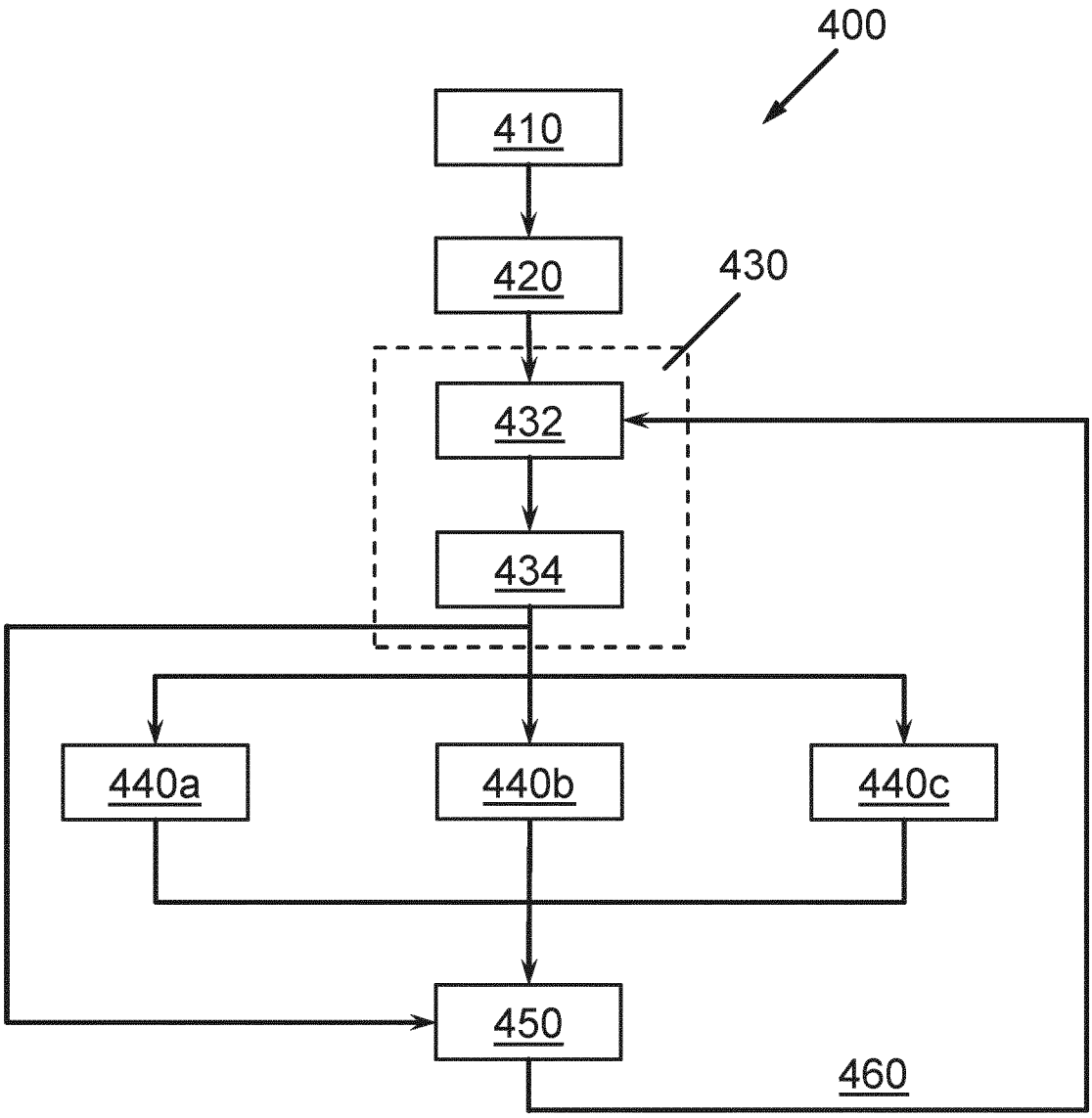
FIG. 28 shows, in block diagram form, a method according to an embodiment.

FIG. 28 shows, in block diagram form, a method 400 according to an embodiment.

The method 400 includes a step 410 of providing a system according to the present disclosure whereby forces withstood by wear elements of the system can be measured. The wear elements of the system are coupled with a blade of a bucket of an earth moving machine.

The method 400 further includes a step 420 of measuring forces (e.g. strains, unitary deformations) with the sensor(s) of the system.

The method 400 further includes a step 430 of processing the measurements in order to calculate forces withstood by the wear elements. Central control means of the system carry out the processing such that the means process 432 the measurements of each sensor in order to calculate the forces withstood and the force values calculated in said processing 432 are then processed 434 together (when more than one sensor is in the system) with the force values calculated for the other sensors, in this way it can be determined the behavior of the wear elements by means of all the measurements. That is to say, firstly the measurements of each sensor are processed 432, and then the calculated force values are processed 434 in combination for assessing the force withstood by the wear elements; the result may then be provided 450 to a control center of a machine, for example.

The method may further include determining, with the central control means, an action 440*a*-440*c* to be performed based on the combined force values 434, and providing said action in the form of output instructions that are transmitted to a control center in step 450.

The actions to be performed are, for instance:

- emitting 440*a* a warning in the form of at least one perceptible signal whenever the calculated force values of step 434 exceed a first predetermined threshold (e.g. predetermined excessive force threshold), or are less than a second predetermined threshold (e.g. predetermined optimal force threshold);
- increasing 440*b* a breakout force of the machine by either assisting an operator thereof (by adjusting the commands of the operator) or automatically commanding the machine to do so whenever the calculated force values of step 434 are less than the second predetermined threshold; and
- reducing 440*c* a breakout force of the machine by either assisting an operator thereof (by adjusting the commands of the operator) or automatically commanding the machine to do so whenever the calculated force values of step 434 are greater than the first predetermined threshold.

Lastly, the method 400 includes repeating 460 the calculation 432, 434 of force values in accordance with further measurements 420 of the sensor(s), determination 440*a*-440*c* of an action based upon them (if any action needs to be taken), and providing 450 the force values or output instructions to the control center. The steps are preferably repeated 460 during the entire excavation procedure.

FIGS. 29-32 show exemplary ways of adjusting excavation and load operations of an earth moving machine.

Figure 29:
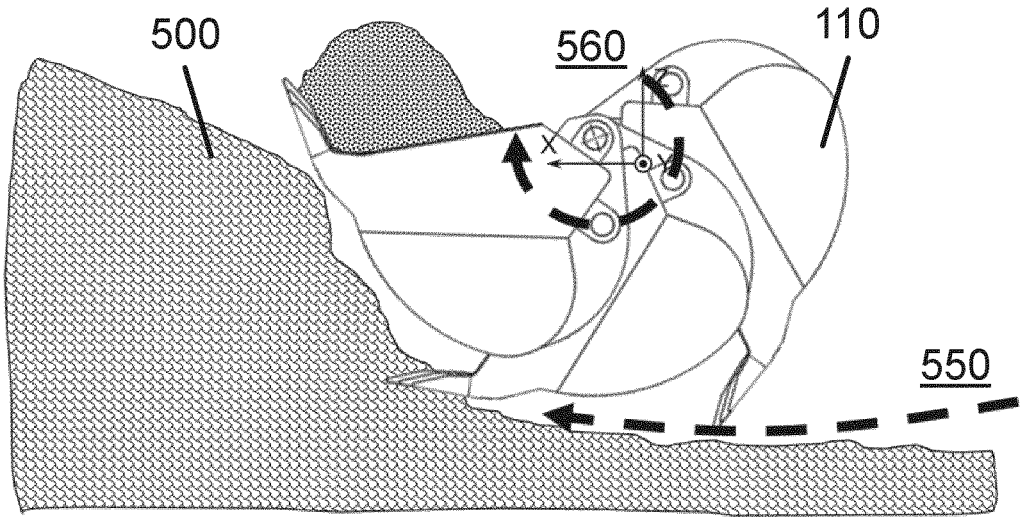
FIGS. 29-32 show exemplary ways of adjusting excavation and load operations of an earth moving machine.

Concerning FIG. 29, material 500 to be charged is e.g. homogeneous and loose (or uncompacted). The machine moves the bucket 110, by means of the boom and stick thereof, according to a trajectory 550 intended to engage the material 500 with the wear elements that forms an angle with respect to the material 500 that is as close as possible to being 90°. Once engaged, the force values calculated by the central control means are monitored in case excessive force is being exerted on the wear elements. Then, the bucket 110 is rotated according to rotating motion 560, thereby causing a change in the angle of attack of the bucket 110 as the material 500 is charged for introduction in the bucket 110; this is preferably carried out such that the bucket 110 is as parallel as possible to the surface of the material 500. Then, when the bucket 110 is filled up with the material 500, the rotating motion 560 continues so as to have the bucket 110 facing upwardly so that the material 500 does not fall off from it, at which point the machine moves towards a truck onto which it discharges the material 500.

Figure 30:
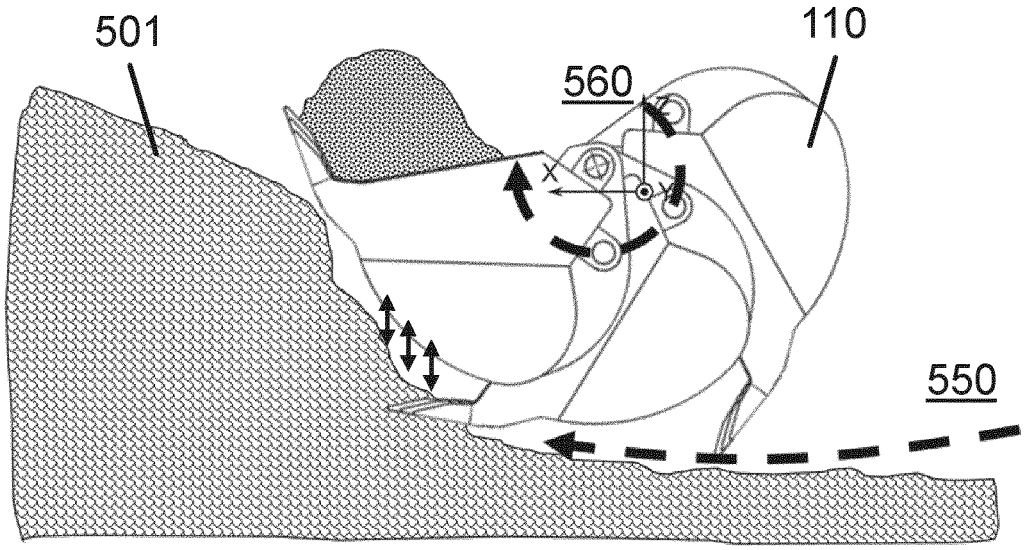

In FIG. 30, material 501 to be charged is e.g. homogeneous and compacted. The machine moves the bucket 110 according to a trajectory 550 like the one described with reference to FIG. 29. Upon engaging the material 501 with the GETs, the forces as calculated by the central control means exceed a predetermined excessive force threshold. The central control means provide output instructions for either emitting a warning to inform an operator of the machine (if any, that is, if the operator is not autonomous) or modifying (or assisting the operator to modify) the trajectory of the bucket 110 so that it is moved upwardly and downwardly in small movements (as illustrated with arrows) while trying to perform the rotating motion 560 for charging the material 501. These movements are intended to open up the material 501, which is compacted, so as to reduce the force exerted by it on the GETs and allow to further charge the material 501. The material 501 frees and the bucket 110 further rotates until the material 501 fills up the bucket 110, then the machine transports it to the truck and discharges it.

Figure 31:
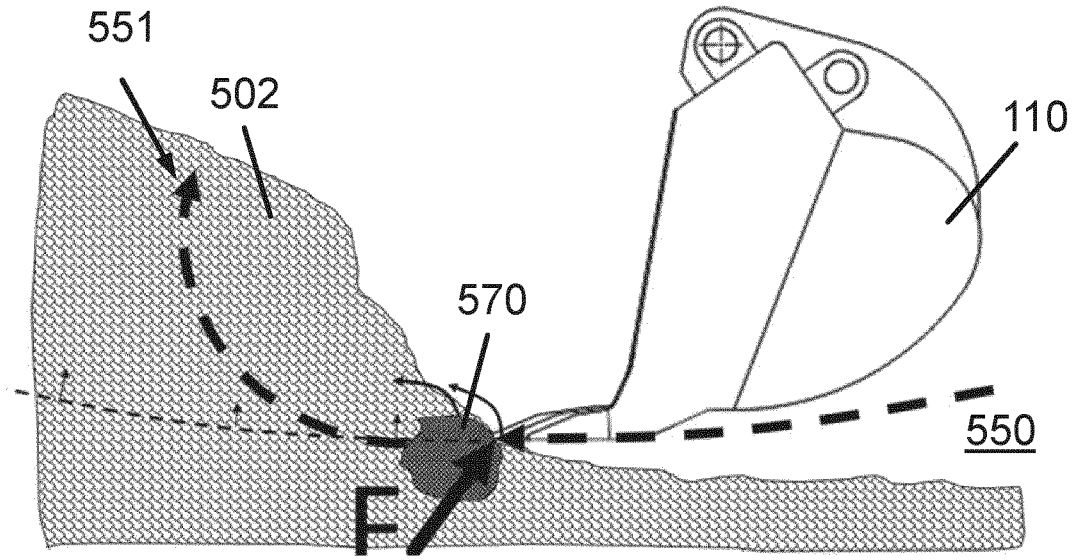

FIG. 31 shows material 502 to be charged that is e.g. heterogenous and loose. The trajectory 550 followed by the bucket 110 is the same as explained in the two previous examples. When the material 502 is contacted by the wear elements, the calculated forces are below the predetermined excessive force threshold. During the rotating motion to fill up the bucket 110 with the material 502, a rock 570 blocks the movement of the bucket 110 and exerts a force on the GETs that is excessive according to the threshold. In this case, the breakout force can be either maintained or reduced so as to lower the risk of damaging the wear elements, and the same up-and-down motion of FIG. 30 is attempted with the bucket 110 in case it is possible to stop being blocked by the rock 570 and continue the rotating motion 551 for filling up the bucket 110 with the material 502.

Figure 32:
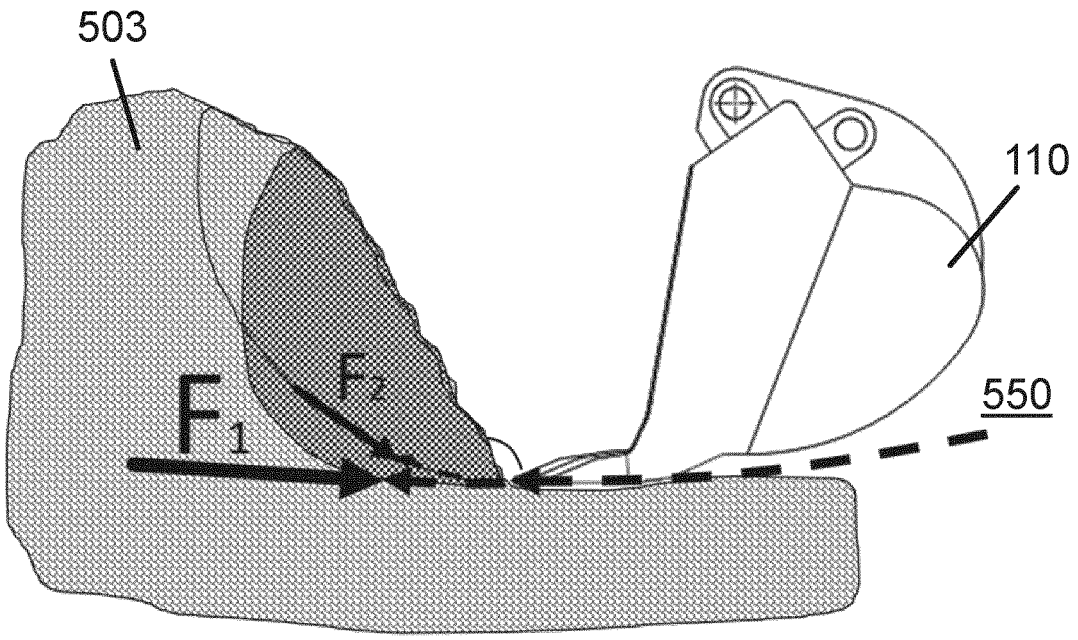

Lastly, in FIG. 32, the characteristics of the material 503 are not known. The machine moves the bucket 110 according to the aforementioned trajectory 550 so as to engage the material 503. After engaging the material 503, the forces are calculated and the angle thereof as well, thereby revealing that a first force $F_1$ is of greater magnitude than $F_2$, which unlike $F_1$ is not in the axial direction of the wear elements. Based on the calculated angle and the magnitude of both forces, the trajectory of the bucket 110 is to be adjusted so that the angle of attack is such that $F_2$ is substantially in the axial direction of the wear elements; to this end, the central control means provide instructions accordingly, either for informing the operator or for automatically adjusting the trajectory or the angle of attack. In this way, lower force is exerted on the wear elements and the charging operation can be effected more efficiently and with fewer damages on the wear elements.

In this text, the term "comprises" and its derivations (such as "comprising", etc.) should not be understood in an excluding sense, that is, these terms should not be interpreted as excluding the possibility that what is described and defined may include further elements, steps, etc.

On the other hand, the invention is obviously not limited to the specific embodiment(s) described herein, but also encompasses any variations that may be considered by any person skilled in the art (for example, as regards the choice of materials, dimensions, components, configuration, etc.), within the general scope of the invention as defined in the claims.

The invention claimed is:

1. A system for earth moving machinery, comprising:

a plurality of wear elements adapted for coupling with digging implements of an earth moving machine;

one or more sensors for measuring forces, each sensor of the one or more sensors being arranged in a wear element of the plurality of wear elements either on an outer surface of said wear element or in a cavity formed on said outer surface; and central control means comprising at least one processor and at least one memory for processing measurements of the one or more sensors in order to calculate force withstood by the wear elements;

wherein the central control means provide output instructions at least based on the processed measurements so that the output instructions comprise at least:

reducing a breakout force of the machine when the processed values exceed a predetermined excessive force threshold; and increasing the breakout force when the processed values are less than a predetermined optimal force threshold; and wherein the plurality of wear elements comprises at least one of: teeth, tooth bars, front guards, side guards, pins, clamps, or a combination thereof.

2. The system according to claim 1, wherein at least one sensor of the one or more sensors is arranged in a cavity formed in the respective wear element in which the at least one sensor is arranged.

3. The system according to claim 2, wherein the at least one sensor is arranged in a wall delimiting the cavity.

4. The system according to claim 2, wherein:

one or more wear elements of the plurality of wear elements having the at least one sensor arranged therein have axial, transversal and vertical axes; and one, some or each sensor in the cavity is/are arranged in one or more walls delimiting the cavity with respect to the transversal or vertical axis thereof, and/or one, some or each sensor in the cavity is/are arranged in a wall delimiting the cavity with respect to the axial axis thereof.

5. The system according to claim 1, wherein increasing and reducing the breakout force comprises at least one of:

increasing and reducing, respectively, pressure applied to cylinders of a hydraulic system of the machine;

changing an angle of attack of the digging implements so as to increase and reduce, respectively, the breakout force; and changing a trajectory followed by the digging implements so as to increase and reduce, respectively, the breakout force.

6. The system according to claim 1, wherein the central control means are configured to receive one or more inputs of the machine, and the central control means provide the output instructions further based on the one or more inputs.

7. The system according to claim 6, wherein the one or more inputs comprise one or more of: power that the machine supplies, breakout force, energy consumption, and performance of a hydraulic system of the machine.

8. The system according to claim 1, wherein one, some or each sensor of the one or more sensors is arranged in any one of: teeth, tooth bars and fixing elements of the plurality of wear elements.

9. The system according to claim 8, wherein each sensor of the one or more sensors is arranged in the tooth bars.

10. The system according to claim 8, wherein each sensor of the one or more sensors is arranged in the teeth or the fixing elements.

11. The system according to claim 1, wherein one, some or each sensor of the one or more sensors is arranged between two wear elements of the plurality of wear elements.

12. The system according to claim 1, wherein the central control means comprise at least one processor and at least one memory per wear element of the plurality of wear elements.

13. An earth moving machine comprising:

digging implements;

a plurality of wear elements adapted for coupling with the digging implements;

one or more sensors for measuring forces, each sensor of the one or more sensors being arranged in a wear element of the plurality of wear elements either on an outer surface of said wear element or in a cavity formed on said outer surface;

central control means comprising at least one processor and at least one memory for processing measurements of the one or more sensors in order to calculate force withstood by the wear elements; and a control center for operating the machine;

wherein the central control means provide output instructions at least based on the processed measurements so that the output instructions comprise at least:

reducing a breakout force of the machine when the processed values exceed a predetermined excessive force threshold; and increasing the breakout force when the processed values are less than a predetermined optimal force threshold;

wherein the central control means are communicatively coupled with the control center;

wherein the central control means provide the output instructions to the control center for operating the machine;

wherein the control center operates the machine at least based on the output instructions such that the machine is at least partially operated by instructions provided by the control center; and wherein the plurality of wear elements comprises at least one of: teeth, tooth bars, front guards, side guards, pins, clamps, or a combination thereof.

14. The earth moving machine according to claim 13, further comprising:

computer vision means;

first means for detecting both position and orientation of a boom of the machine;

second means for detecting both position and orientation of a stick of the machine; and third means for detecting both position and orientation of the digging implements.

15. The earth moving machine according to claim 14, wherein the control center operates the machine at least based on the output instructions such that the machine is completely operated by instructions provided by the control center.

16. The earth moving machine according to claim 13, wherein the central control means comprise at least one processor and at least one memory per wear element of the plurality of wear elements.

17. A method comprising the steps of:

providing a system in an earth moving machine, the system comprising:

a plurality of wear elements adapted for coupling with digging implements of an earth moving machine; and one or more sensors for measuring forces, each sensor of the one or more sensors being arranged in a wear element of the plurality of wear elements either on an outer surface of said wear element or in a cavity formed on said outer surface;

measuring strains or unitary deformations with the one or more sensors;

processing the measurements of the one or more sensors with central control means comprising at least one processor and at least one memory so as to calculate forces based on the measurements;

reducing a breakout force of the machine in an automatic manner when the calculated forces exceed a predetermined excessive force threshold; and increasing the breakout force in an automatic manner when the calculated forces are less than a predetermined optimal force threshold;

wherein the plurality of wear elements comprises at least one of: teeth, tooth bars, front guards, side guards, pins, clamps, or a combination thereof.

18. The method according to claim 17, wherein increasing and reducing the breakout force comprises at least one of:

increasing and reducing, respectively, pressure applied to cylinders of a hydraulic system of the machine;

changing an angle of attack of the digging implements so as to increase and reduce, respectively, the breakout force; and changing a trajectory followed by the digging implements so as to increase and reduce, respectively, the breakout force.

19. The method according to claim 17, wherein:

the machine comprises a control center for operating the machine;

the control center operates the machine such that the machine is at least partially operated by instructions provided by the control center.

20. The method according to claim 19, wherein the control center operates the machine such that the machine is completely operated by instructions provided by the control center; and wherein the machine further comprises:

computer vision means;

first means for detecting both position and orientation of a boom of the machine;

second means for detecting both position and orientation of a stick of the machine; and third means for detecting both position and orientation of the bucket.

21. The method according to claim 17, wherein the central control means comprise at least one processor and at least one memory per wear element of the plurality of wear elements.

* * * * *